US012747594B2

(12) United States Patent
Boucké

(10) Patent No.: US 12,747,594 B2
(45) **Date of Patent: *Sep. 29, 2026**

(54) PANEL, COVERING, AND METHOD FOR MANUFACTURING SUCH A PANEL

(71) Applicant: i4F Licensing NV, Turnhout (BE)

(72) Inventor: Eddy Alberic Boucké, Turnhout (BE)

(73) Assignee: i4F Licensing NV, Turnhout (BE)

( * ) Notice: Subject to any disclaimer, the term of this patent is extended or adjusted under 35 U.S.C. 154(b) by 0 days.

This patent is subject to a terminal disclaimer.

(21) Appl. No.: 19/355,409

(22) Filed: Oct. 10, 2025

(65) Prior Publication Data

US 2026/0035931 A1 Feb. 5, 2026

Related U.S. Application Data

(63) Continuation of application No. 18/246,918, filed as application No. PCT/EP2021/076943 on Sep. 30, 2021, now Pat. No. 12,460,422.

(30) Foreign Application Priority Data

Sep. 30, 2020 (NL) ..... 2026581

(51) Int. Cl.
*E04F 15/02* (2006.01)

(52) U.S. Cl.
CPC .. *E04F 15/02016* (2013.01); *E04F 15/02033* (2013.01); *E04F 15/02038* (2013.01); (Continued)

(58) Field of Classification Search
CPC ..... E04F 15/02016; E04F 15/02038; E04F 15/107; E04F 13/14; E04F 2201/042; E04F 2201/0107; E04F 2201/03; E04F 15/08; E04F 2201/0115; E04F 2201/0153; E04F 15/02033; E04F 2201/0552; E04F 2201/023; E04F 2201/0535; E04F 2201/0146; E04F 2201/043; E04F 2201/0547; E04F 2290/00; E04F 2201/0138; B32B 2471/00; B32B 3/06; B32B 7/12; B32B 19/04; B32B 2307/546; B32B 2419/04; B32B 2607/00
See application file for complete search history.

(56) References Cited

U.S. PATENT DOCUMENTS 5,502,939 A 4/1996 Zadok
6,006,486 A 12/1999 Moriau et al.
(Continued)

FOREIGN PATENT DOCUMENTS

DE 102007049021 A1 4/2009
EP 2063044 A1 5/2009
(Continued)

*Primary Examiner* — Chi Q Nguyen
(74) *Attorney, Agent, or Firm* — The Webb Law Firm

(57) ABSTRACT

A panel and a method of manufacturing a panel, such as a floor panel, a wall panel or a ceiling panel, in particular a decorative floor panel including at least a first edge having a first coupling part configured to be coupled to a second coupling part of another panel. At least one expandable material located adjacent at least a part of an upper portion of the first edge. A covering, in particular a floor covering, comprising multiple interconnected panels is also provided.

22 Claims, 5 Drawing Sheets

(52) U.S. Cl.
CPC . *E04F 2201/0146* (2013.01); *E04F 2201/023* (2013.01); *E04F 2201/042* (2013.01); *E04F 2201/043* (2013.01); *E04F 2290/00* (2013.01)

(56) References Cited

U.S. PATENT DOCUMENTS

| | | | | |
|---|---|---|---|---|
| 7,584,583 | B2 * | 9/2009 | Bergelin | E04C 2/24 52/177 |
| 8,220,217 | B2 | 7/2012 | Muehlebach | |
| 8,938,929 | B2 | 1/2015 | Engstrom | |
| 10,858,846 | B2 | 12/2020 | Loebel | |
| 11,002,021 | B2 * | 5/2021 | Cappelle | E04F 15/02 |
| 11,060,302 | B2 | 7/2021 | Ylikangas | |
| 11,377,856 | B2 | 7/2022 | Boucké | |
| 11,987,992 | B2 | 5/2024 | Boo | |
| 12,104,388 | B2 | 10/2024 | Eisermann | |
| 12,180,719 | B2 | 12/2024 | Meersseman | |
| 12,320,130 | B2 * | 6/2025 | De Rick | B27F 1/02 |
| 12,460,422 | B2 * | 11/2025 | Boucké | E04F 15/02033 |
| 2004/0182036 | A1 * | 9/2004 | Sjoberg | E04F 15/02 52/592.1 |
| 2007/0006543 | A1 | 1/2007 | Engstrom | |
| 2008/0236088 | A1 * | 10/2008 | Hannig | F16B 5/0056 52/592.1 |
| 2009/0193741 | A1 * | 8/2009 | Cappelle | E04F 15/045 29/897.3 |
| 2009/0260313 | A1 | 10/2009 | Segaert | |
| 2011/0271632 | A1 | 11/2011 | Cappelle | |
| 2013/0305649 | A1 | 11/2013 | Thiers | |
| 2015/0337542 | A1 | 11/2015 | Cappelle | |
| 2022/0136257 | A1 | 5/2022 | Cappelle | |
| 2023/0235571 | A1 | 7/2023 | Larsson | |

FOREIGN PATENT DOCUMENTS

| | | | |
|---|---|---|---|
| EP | 2013034 | B1 | 6/2014 |
| EP | 2918747 | A1 | 9/2015 |
| EP | 3473783 | A1 | 4/2019 |
| EP | 3626908 | A1 | 3/2020 |
| WO | 2007113676 | A2 | 10/2007 |
| WO | 2019137964 | A1 | 7/2019 |

* cited by examiner

PANEL, COVERING, AND METHOD FOR MANUFACTURING SUCH A PANEL

CROSS-REFERENCE TO RELATED APPLICATIONS

This application is a continuation of U.S. patent application Ser. No. 18/246,918, filed Sep. 30, 2021, which is the United States national phase of International Application No. PCT/EP2021/076943, filed Sep. 30, 2021, and claims priority to The Netherlands Patent Application No. 2026581, filed Sep. 30, 2020, the disclosures of which are hereby incorporated by reference in their entireties.

BACKGROUND OF THE INVENTION

Field of the Invention

The present invention relates to a panel, such as a floor panel, a wall panel or a ceiling panel, in particular a decorative floor panel. The invention also relates to a covering, in particular a floor covering, comprising multiple interconnected panels according to the invention. The invention also relates to a method of manufacturing a panel according to the invention. The invention moreover relates to a transfer foil of the type which can be applied for covering at least a part of at least upper edge portion of a panel according to the invention.

Description of Related Art

The last decades has seen enormous advance in the market for flooring for floor covering. It is known to install floor panels on a underlying floor in various ways. It is, for example, known that the floor panels are attached at the underlying floor, either by gluing or by nailing them on. This technique has a disadvantage that is rather complicated and that subsequent changes can only be made by breaking out the floor panels. According to an alternative installation method, the floor panels are installed loosely onto the subflooring, whereby the floor panels mutually match into each other by means of a tongue and groove coupling, whereby mostly they are glued together in the tongue and groove, too. The floor obtained in this manner, also called a floating floor, has as an advantage that it is easy to install and that the complete floor surface can move which often is convenient in order to receive possible expansion and shrinkage phenomena. Whereas flooring used to be made of wood or wood-derived products, lately the market has evolved towards plastic-based panels, like PVC panels and even towards mineral-based panels, like magnesium-oxide based panels. A shared inevitable drawback is that seams (panel joints) are formed in between interlocked floor panels, in which dust, water, in particular moisture, or other liquids can penetrate which will lead to fouling within the floor covering, which will increase the risk of bacteria and fungi growth in cavities formed in between said floor panels, which is typically undesired from a hygienic point of view.

SUMMARY OF THE INVENTION

It is a first goal of the present invention to provide an improved interlockable panel.

It is a second goal of the present invention to provide an improved panel for protection against the penetration of moisture or liquids through panel joints.

At least one of these goals can be achieved by providing a panel, in particular a floor panel, more in particular a decorative floor panel, comprising: at least one first edge and at least one opposite second edge, wherein said first edge comprises a first edge portion, in particular a first upper edge portion, wherein said second edge comprises a second edge portion, in particular a second upper edge portion; at least one first coupling part arranged on said first edge, and at least one second coupling part arranged on said opposite second edge, wherein the first coupling part of said panel and the second coupling part of another panel are arranged to be coupled to provide a locking of two coupled panels, such that a least a part of the first (upper) edge portion faces, in particular co-acts or is configured to co-act with, at least a part of the second (upper) edge portion to form a (top) seam in between the panels; wherein at least a part of at least one edge portion, in particular at least one upper edge portion is provided with at least one expandable material layer which comprises at least one material configured to expand or swell upon contact with moisture.

The panel, typically a decorative (floor) panel, according to the invention has several advantages. The panels allow can be easily installed without additional efforts and at the same time have an improved protection against ingress and penetration of moisture and liquids at the joints (seam). Since the at least one expandable material layer is initially applied in unswollen, compact state, the at least one expandable material layer will not cause additional friction during interlocking of two panels, as a result of which an easy installation can be preserved. Hence, the application of at least one (thin) expandable material layer also constitutes a subtle way to make the connection in between interlocked panels waterproof after installation. Moreover, a material layer has a favourable area surface/volume ratio compared to bulky solutions, like three-dimensionally profiled parts and cables. Since the expandable material is incorporated in a layer, such as a (thin) strip, the cost price can be kept low and, moreover, the expandable layer merely takes a bit of space, which is in favour of preserving a desired panel design, in particular coupling part design. The one or more expandable layers is/are preferably positioned at one or more upper edge portions of the panel, since these upper edge portions typically define a top seam (upper joints) formed in between two panels being which can be easily exposed to moisture and liquids. Hence, it is therefore preferred to realize a tightened, preferably waterproof, top seam once the top seam is exposed to moisture (water) or other any liquid. During swelling of the expandable material, the (top) seam, also referred to as the panel joint, is preferably tightened, wherein the expanding (during swelling) and/or expanded (after swelling) material exerts a force to an opposing edge portion of an adjacent panel in order to tighten the seal. This force may be considerably larger than the initial force, if present, within or at the (top) seam, directly after coupling of two panels when the expandable material is still in unexpanded (unswollen) state. Hence, during swelling a clamping force or tightening forces will be initiated or increased to substantially entirely seal the (top) seam.

The term "panel" in the sense of this document means in particular floor panel, wall panel, ceiling panel, door panel, or furniture panel. The panel is preferably a decorative panel, wherein a panel core can have a decorative character and/or wherein a decorative layer is applied to said core. Decorative panels are used in a variety of ways, both in the field of interior design of rooms as well as decorative cladding of buildings, for example in exhibition stand construction. One of the most common fields of application of decorative panels is their use as a floor covering, both indoor floor covering and outdoor floor covering. The decorative panels often have a decoration that is intended to replicate a natural material and/or a tiling or tessellation.

The term "expandable" in the sense of this document means "swellable", which has to be understood as the property of a material to swell or to increase its volume by absorption of gas and/or liquid. The increase in volume may be, for example, a doubling or a tenfold increase in volume.

As said, at least one expandable material layer is preferably positioned such that during expanding or swelling of said expandable material layer upon contact with moisture, the top seam is tightened, preferably substantially closed, more preferably substantially closed in a waterproof manner. Hence, the expandable material is preferably configured, in expanded state (swollen state), to realize a (hydraulic) sealing effect, wherein the expanded material layer (after wettening) of a first panel, is typically configured to abut a part, in particular an upper edge portion, of an second panel coupled to said first panel.

Preferably, the panel comprises a core, wherein the expandable material layer is affixed, either directly or indirectly, onto said core. Preferably, at least a part of the upper edge portions make integral part of and/or are defined by said core. Preferably, at least a part of the first edge and at least a part of the second edge make integral part of and/or are defined by said core. Preferably, at least a part of each coupling parts make integral part of the core. The coupling parts are typically realized by profiling the core by means of milling. It is, however, also conceivable that at least a part of at least one coupling part is formed by at least one separate resilient (snap) tab or tongue, which is connected with the first edge and/or the second edge, and which is configured to co-act with an opposite edge of an adjacent panel in locked condition, to realize an interlocking between said panels, preferably both in horizontal direction (within the pane define by the panel(s)) and in vertical direction (perpendicular to the plane defined by the panel(s)).

The panel according to the invention is typically provided with a water impermeable top layer, in particular top coating, such as a (UV hardened) lacquer layer, which prevents the one or more underlying layers, such as the core, underneath from exposure to moisture. Instead or in addition to a top coating, such as a lacquer layer, it is also imaginable that (at least a part of) the top layer is formed by at least one tile, preferably a tile which is at least partially made of a material chosen from the group consisting of: sliceable natural stone, marble, concrete, limestone, granite, slate, glass, and ceramics. Typically these one or more tiles are glued onto the core of the panel. The panel edges, and in particular the seam(s) formed in between interlocked panels are typically not protected by said top layer, in particular top coating. It is preferred to apply at least one expandable material layer at the location(s) which are typically unprotected, and hence most vulnerable and susceptible for moisture ingress. In practice, with conventional panels, when water is applied or dropped on top of a panel, and particularly on the seam (joint) in between interconnected panels, water commonly seeps into said seam, and will be collected by cavities formed in between co-acting coupling parts, which not only provides a basis for undesired growth of bacteria and fungi, but which may also affect one or more layers of the panel which is/are susceptible for water, such as e.g. a wood comprising layer, such that this/these layer(s) will degrade and/or swell, which in turn will affect the panel as such. To prevent or counteract that other constructive panel layers than an (optional) top coating are exposed to water, it is preferred that at least one expandable material layer is applied to at least one upper edge portion of the panel. This position-selective location will block water ingress at the top of the (top) seam preventing water to seep and collect in between the panels and eliminates or at least seriously reduces the risk that moisture vulnerable (constructive) layers, such as the core, of the panel are affected. This also results in the situation the freedom of design of the core composition is increased, since moisture resistance as boundary condition for the core does no longer at least less play a role when choosing and developing a desired core composition. Preferably, in coupled condition of two adjacent panels, the at least one expandable material layer provided at least one upper edge portion of a panel is at least partially covered by an opposing upper edge portion of an adjacent panel. Typically, at least a part of the expandable layer is positioned on a vertical wall part of the upper edge portion, wherein said vertical wall part is configured to engage an opposing upper edge portion of an adjacent panel. By covering at least a part, preferably an exposed part (left uncovered part), of the expandable material by an adjacent panel, it can also be prevented that the expandable material will prematurely swell due to atmospheric moisture absorption.

Preferably, at least one expandable material layer provided is partially covered by at least one protective layer, preferably a water impermeable protective layer, and wherein an exposed portion of said expandable material layer is in direct contact with the surrounding atmosphere, preferably to prevent prematurely swelling prior to installation. Such a protective layer may be formed by a top layer, in particular coating, of the panel and/or may be formed by an alternative covering layer. The protective layer is typically a closed water impermeable layer. However, it is imaginable that the protective layer comprises one or more position-selective openings (through-holes) exposing position-selective parts of the expandable layer. In this latter way guidance can be given to the swelling location of the expandable layer.

In a preferred embodiment, the first one upper edge portion is provided with at least one first expandable material layer and wherein the second upper edge portion is provided with at least one second expandable material layer. Preferably, each upper edge portion is provided with at least one expandable material layers, wherein, in coupled condition of adjacent panels, expendable material layers of opposing upper edge portions are configured to co-act with each other. In this manner an improved watertight seal can be realized. It is imaginable that at least one upper edge portion is provided with a plurality of expandable material layers, wherein each expandable material layer comprises at least one material configured to expand or swell upon contact with moisture. In this manner, the watertight barrier at the top seam may (also) be improved.

Preferably, at least one expandable material layer is formed by a material strip. This strip may be fused, glued, digitally printed, transfer printed, and/or chemically or physically deposited onto a panel edge. The expandable material layer, in particular strip, may define a single plane, and hence may be flat. It is also imaginable that at least one expandable material layer follows the shape of a curved and/or angled portion of a coupling part. Preferably, the (maximum) thickness of the material layer (9) is between 10 and 1000 micron, more preferably between 20 and 500 micron, in particular between 50 and 250 micron. It is conceivable that the thickness of at least one expandable material layer and/or the amount or density of expandable material in the expandable material layer varies in lateral direction, and preferably decreases in a direction away from an outer end of the panel edge. This will lead to the situation that most of the expandable material is positioned at a desired location, at a panel edge and will lead to an expandable material saving more distant from the panel edge.

Preferably the thickness of the expandable material layer increases by at least a factor 2 upon contact with moisture or water, as measured in cross-section. Such thickness and/or increase in thickness has proven to be the right balance between controlled expansion and creating a reliable and durable water barrier in between interlocked panels.

Preferably, the thickness of the expandable layer varies along its length, and preferably increases in a direction away from a, preferably vertical, part of the upper edge portion configured to co-act with the upper edge portion of an adjacent panel. In order to apply a varying thickness of the expandable layer along its length, the thickness of each expandable layer section can be optimized and tailored dependent on the specific design of the first coupling part and second coupling part. In this case the expandable layer may be provided with one or more thicker portions, in case the design of the coupling parts allows so, and with one or more thinner portions, in case e.g. there is less intermediate space in between the coupling parts.

In a preferred embodiment, at least one upper edge portion is provided with a channel-shaped recessed portion extending along the length of one said upper edge portion, wherein the recessed portion is configured to adjoin an upper edge portion of an adjacent panel, in coupled condition of two panels. Preferably, in coupled condition of two panels, the adjoining upper edges enclose a groove, such as a U-shaped groove or a V-shaped groove, preferably representing a grout line. In case the panels are wettened, water will be inclined to collect and remain in the recessed portion(s). Hence, it is preferred that a bottom portion and/or side wall portion of the recessed portion, connecting to a side wall of the upper edge portion, is provided with at least one expandable material layer. Preferably, each of the first upper edge portion and the second upper edge portion is provided with a channel-shaped recessed portion extending along the length of one said upper edge portion, wherein the recessed portions of adjacent panels are configured to connect to each other to form a single groove. It is also imaginable, and often preferred, that the first upper edge portion is provided with a channel-shaped recessed portion extending along the length of one said upper edge portion, and wherein the second upper edge portion comprises a substantially vertical wall part configured to connect to recessed portion of the first upper edge portion of an adjacent panel. Said vertical wall part may (also) be provided with an expandable material layer. An additional advantage of this embodiment is that the top seam (joint) is less visible, which is attractive from the aesthetic point of view. Moreover, in this embodiment it can be realized that the deepest point (or zone) of the recessed portion is positioned at a (small) distance from the edge, and hence at a (small) distance from the seam, which is in favour of the object to prevent moisture seepage into the seam.

Preferably, at least one upper edge portion provided with channel-shaped recessed portion comprises a vertical wall part positioned below and connecting to said channel-shaped recessed portion, wherein both at least a part of the channel-shaped recessed portion and at least a part of the vertical wall part are covered by at least one expandable material layer. More preferably, the thickness of the expandable material layer section covering the vertical wall part is smaller than the thickness of the expandable material layer section covering the channel-shaped recessed portion. Hence, it is advantageous that the seam in between upper edge portions of adjacent panels may be provided with a relatively thin expandable layer (section), while the channel-shaped recessed portion is provided with a thicker expandable layer (section). This may improve the overall water barrier properties of the seal formed in between interlocked panels after expansion of the layer.

In a preferred embodiment at least one upper edge portion comprises a bevel connecting an upper side of the panel and a side wall of the panel, wherein, preferably, said bevel has an angle of inclination of about 12 degrees to about 30 degrees relative to said upper side of the panel. The bevel can be considered as a chamfered edge. It is imaginable that the bevel(s) make(s) part of the aforementioned groove. It is also imaginable that at least one bevel, preferably a bevel directly connecting to the (outer) edge is provided with at least one expandable material layer.

Preferably, the expandable material layer is at least partially enclosed by a core of the panel and a decorative layer of the panel. It is also imaginable that the expandable material layer and the decorative layer are integrated, wherein expandable material is e.g. mixed with decorative material. It is imaginable that the expandable material layer is coloured, wherein preferably the material layer is coloured to mimic concrete or panel grout lines. The expandable material layer is typically provided on the upper side of the panels, and thus faces the end user. The upper surface of the panel may for instance be provided with a decorative layer imitating a wooden floor or ceramic tiles. Traditionally ceramic tiles are spaced apart, wherein the intermediate space between the tiles is filled with a grout, or a filler. This is typically another colour compared to the tile. To mimic this effect, the material layer may be coloured accordingly. It is imaginable, and often preferable, that the expandable material layer comprises one or more additives, such as a colouring agent, a binding agent, and/or an antimicrobial substance. Since the expandable material layer is configured to be exposed to moisture/water, during use, it is beneficial to add at least one antimicrobial substance to this expandable material layer, to further reduce the risk of bacteria growth and/or the formation of a microbial habit on the panel and in between interlocked panels, which is in favour of the health safety of the panels, and which expands the applicability of the panels. In a preferred embodiment, the antimicrobial substance is at least one antimicrobial substance chosen from the group consisting of:

1-[[2-(2,4-dichlorophenyl)-4-propyl-1,3-dioxolan-2-yl]methyl]-1H-1,2,4-triazole (Propiconazole);
(benzothiazol-2-ylthio)methyl thiocyanate (TCMTB);
1-(4-chlorophenyl)-4,4-dimethyl-3-(1,2,4-triazol-1-ylmethyl)pentan-3-ol (Tebuconazole);
1-[[2-(2,4-dichlorophenyl)-4-propyl-1,3-dioxolan-2-yl]methyl]-1H-1,2,4-triazole (Propiconazole);
2-butyl-benzo[d]isothiazol-3-one (BBIT);
2-octyl-2H-isothiazol-3-one (OIT);
2-thiazol-4-yl-1H-benzoimidazole (Thiabendazole);
3-iodo-2-propynylbutylcarbamate (IPBC);

4,5-Dichloro-2-octylisothiazol-3(2H)-one (DCOIT));
10,10-oxybisphenoxarsine (OBPA);
Carbendazim;
Chlorocresol;
Fludioxonil;
N-(trichloromethylthio)phthalimide (Folpet);
p-[(diiodomethyl)sulphonyl]toluene;
Pyrithione zinc (Zinc pyrithione (Zpt));
Terbutryn; and
Thiram Preferably, at least one antimicrobial substance is formed by zinc pyrithione (or pyrithione zinc) which is a coordination complex of zinc. It has fungistatic (that is, it inhibits the division of fungal cells) and bacteriostatic (inhibits bacterial cell division) properties. Alternatively, at least one antimicrobial substance is based on and/or may be formed by N-butyl-1,2-benzisothiazolin-3-one (BBIT) and is recommended for use in tough and demanding applications especially those exposed to high UV levels.

Preferably, the core composition is free of any expandable material to secure the shape of the core, and hence of the panel, and to keep the cost price as low as possible. It is conceivable that the bottom surface of the core is provided with a back layer. It is also imaginable that one or more lower edge portions is/are provided with at least one expandable material layer to water tightly close off a bottom seam in between to panel in order to prevent seepage and soakage of water present on subfloor (supporting the panels) into said bottom seam. It is also imaginable that the entire outer surface of at least one coupling part is provided (coated) with at least one expandable material layer.

The expandable material preferably comprises at least one hydrogel-forming water-swellable polymer. In case a hydrogel is used as expandable material, two types of hydrogel can be applied: reversible and permanent hydrogels. Physical crosslinks consist of hydrogen bonds, hydrophobic interactions, and chain entanglements (among others). A hydrogel generated through the use of physical crosslinks is referred to as reversible hydrogel. Chemical crosslinks consist of covalent bonds between polymer strands. Hydrogels generated in this manner are referred to as permanent. The expandable material is preferably swellable by absorbing (aqueous) liquids, wherein the expandable material is preferably at least one material chosen from the group consisting of:

lightly crosslinked hydrophilic polymers,
superabsorbent polymers (SAPs),
acrylonitrile copolymers,
polyacrylamide (co)polymers,
ethylene-maleic acid anhydride copolymers,
a water absorbing material selected from the group consisting of crosslinked carboxy methyl celluloses, compressed celluloses, modified celluloses, cellulose ethers, bran or combinations thereof;
polyvinyl alcohol,
polyethylene glycol,
sodium polyacrylate, preferably crystals thereof and/or particles bentonite clay, amorphous silica or fuller earth, such as palygorskite and/or attapulgite,
acrylate polymers, sodium polyacrylate, sodium acrylate or a combination of acrylic acid and/or sodium acrylate with methylenbisacrylamide,
poly(acrylic acid), or a salt of poly(acrylic acid), potassium salt, lightly cross-linked,
N-isopropylacrylamide (NIPA) copolymerized with acrylic acid,
copolymers with an abundance of hydrophilic groups and natural proteins such as collagen, gelatine and fibrin,
salts, in particular sodium or potassium salts, of one or more of the aforementioned polymers,
combinations of the above.

These material all have the property that they expand upon wetting or contact with moisture, and water in particular. Sodium polyacrylate for instance is a sodium salt of polyacrylic acid with the chemical formula [—CH2-CH(CO2Na)-]n. The material has the ability to absorb 100 to 1000 times its mass in water. Sodium polyacrylate is an anionic polyelectrolyte with negatively charged carboxylic groups in the main chain. Sodium polyacrylate is a chemical polymer made up of chains of acrylate compounds. It contains sodium, which gives it the ability to absorb large amounts of water. When dissolved in water, it forms a thick and transparent solution due to the ionic interactions of the molecules. Sodium polyacrylate has many favourable mechanical properties. Some of these advantages include good mechanical stability, high heat resistance, and strong hydration.

It is also imaginable that the expandable material comprises nanocomposite microgel compositions comprising (i) a base polymer and (ii) a water-swellable mineral nanoclay. Nanocomposite microgels have a three-dimensional network structure and a water-swellable mineral nanoclay crosslinking the network structure. Nanocomposite microgels can possess enhanced swelling properties based on their unique polymer/nanoclay network structure, for example the ability to dramatically swell or shrink in response to a variety of external stimuli such as temperature, pH, ionic strength, electric field, and enzyme activities. These properties make them useful in a wide variety of applications, for example, swellable rubber compounds for the oil and gas industry, superabsorbents for hygienic and agricultural applications. The nanocomposite hydrogel is typically manufactured by the polymerization of water-soluble monomers in an aqueous medium in the presence of a water-swellable nanoclay, and an aqueous polymerization initiator. Thus formed hydrogel is then isolated, and can be dried to form a nanocomposite microgel. Preferably, the nanocomposite microgel particles comprise primary nanocomposite microgel particles having a mean diameter of 1 to 10 micrometres. Preferably, the base polymer is selected from nitrile rubber, hydrogenated nitrile rubber, carboxylated nitrile rubber, carboxylated hydrogenated nitrile rubber, silicone rubber, ethylene-propylene-diene copolymer, fluoroelastomer, perfluoroelastomer, or a combination comprising at least one of the foregoing. Preferably, the water-swellable nanoclay is synthetic layered silicate, such as Laponite.

It is imaginable that the expandable material comprises epoxidized natural rubber (ENR) and a superabsorbent polymer composite (SAPC). Here, the SAPC can e.g. be synthesized by grafting polyacrylamide onto hydroxyethyl cellulose backbones and adding bentonite clay. The ENR typically act as rubber matrix for supporting the SAPC.

Preferably, the first coupling part and the second coupling part of another panel are arranged to be coupled by means of a downward motion; wherein the first coupling part comprises an upward tongue, at least one upward flank lying at a distance from the upward tongue and an upward groove formed in between the upward tongue and the upward flank, wherein the upward groove is adapted to receive at least a part of a downward tongue of a second coupling part of another panel, wherein the side of the upward tongue facing towards the upward flank is the inside of the upward tongue and the side of the upward tongue facing away from the upward flank is the outside of the upward tongue; wherein the second coupling part comprises a downward tongue, at least one downward flank lying at a distance from the downward tongue, and a downward groove formed in between the downward tongue and the downward flank, wherein the downward groove is adapted to receive at least a part of an upward tongue of a first coupling part of another panel, wherein the side of the downward tongue facing towards the downward flank is the inside of the downward tongue and the side of the downward tongue facing away from the downward flank is the outside of the downward tongue. The inside of the downward tongue is preferably inclined, either towards or away from the downward flank. Likewise, the inside of the upward tongue is preferably inclined, either towards or away from the upward flank. The angles of inclination of the inner side of the upward tongue and downward tongue may mutually differ. Preferably, the outside of the downward tongue and the upward flank both comprise an upper contact surface near or at or adjoining or towards a top side of the panel, which upper contact surfaces are arranged to be in contact in coupled condition of the panels and preferably extend vertically at least partly; wherein the outside of the upward tongue comprises a first locking element in the form of an outward bulge and wherein the downward flank is provided with a second locking element, in the form of a recess, wherein at least a part of the first and at least a part of second locking element are arranged to be in contact, in coupled condition of the panels and form a locking element surface. Preferably, the outside of the outward bulge comprises an upper portion and an adjoining lower portion, wherein the lower portion comprises an inclined locking surface and the upper portion comprises a, preferably curved, guiding surface; wherein the recess comprises an upper portion and an adjoining lower portion, wherein the lower portion comprises an inclined locking surface; wherein the parts of the first and second locking element that are in contact, in coupled condition of the panels, are the inclined locking surfaces of the locking elements and/or wherein, in coupled condition of the panels, the upper portions of the first and second locking elements are spaced apart at least partially.

The coupling parts of two panels may interact, and provide for a locking of the panels, typically in a horizontal and vertical direction. The upward tongue is placed into the downward groove and the downward tongue is placed into the upward groove, which provides a locking in the plane of the panel, or the horizontal direction for floor coverings for example.

The outside of the upward tongue comprises a first locking element, for instance in the form of an outward bulge and the downward flank may be provided with a second locking element, for instance in the form of a recess, wherein at least a part of the first and at least a part of second locking element are in contact, in coupled condition of the panels and form a locking element surface. The two locking elements may thus co-act to provide a locking, in particular a locking in vertical direction or perpendicular to the (main) plane of the panels. The first and second locking elements are preferably formed integrally with the panel, and can for instance be milled into the panel material. Applying the mutually co-acting locking elements prevents a substantially vertical displacement of the two panels relative to each other. Either or both the first locking element and the second locking element are preferably connected substantially rigidly to respectively the rest of the panel, such that a relatively durable and strong locking can be realized, since no use is made of relatively weak resilient locking parts in which material fatigue could moreover occur relatively quickly. The first locking element can form an integral part of the upward tongue, wherein the first locking element can for instance be formed by a protruding (outward bulging) or recessed (inward bulging) edge deformation of the upward tongue.

The first locking element may be an outward bulge, wherein the outside of the outward bulge comprises an upper portion and an adjoining lower portion, wherein the lower portion comprises an inclined locking surface and the upper portion comprises a, preferably curved, guiding surface. The first locking element, on the outside of the upward tongue will, during coupling, encounter the downward flank of another panel, as it is the protruding portion of the panel, and typically is the outermost portion of the panel on one side and forces need to be overcome during coupling to force one panel into the other. By providing a (curved) guiding surface on the upper portion, the further or other panel is guided downwards, such that coupling may occur gradually and large material deformations and/or peak stresses can be prevented. The lower portion may thus be inclined, and forms the portion of the bulge which from the outermost part of the bulge returns towards the upward tongue. Also this inclined surface provides a guiding function, guiding the panels towards their final stage. The inclination of the locking surface further allows that a potential upward force or motion of the panels results in a vertical and horizontal force component. The horizontal component may be used to keep the panels together, forcing the panels towards each other, to improve the connection and the waterproof properties of the connection between the panels. The second locking element may be a recess comprising an upper portion and an adjoining lower portion, wherein the lower portion comprises an inclined locking surface, in order to co-act with the first locking element. The inclined surfaces further have the advantage, for instance over rounded surfaces, that they are relatively easy to make or mill, and that it is relatively easy to allow relatively large contact surface between the two to spread out locking forces in coupled panels.

The upper portion may extend over a larger vertical section compared to the lower portion, to gradually guide panels into place. The upper portion typically does not provide a vertical locking effect, such that the horizontal portions thereof are of less relevance compared to the lower portion, which typically does provide a vertical locking effect. The parts of the first and second locking element that are in contact, in coupled condition of the panels, are typically formed by the inclined locking surfaces of the locking elements, so by the lower portions. In coupled condition of the panels the upper portions of the first and second locking elements may be spaced apart at least partially. This spacing allows the upward tongue to move upwardly without being hindered by the downward flank, which upward movement may in turn be transferred and translated into a closing horizontal movement to improve the connection or locking of the panels, forcing the panels together.

The outside of the upward tongue may comprise an upper outside portion and a lower outside portion, wherein the first locking element is arranged between the upper and lower outside portion, wherein the lower outside portion is arranged closer to the inside of the upward tongue compared to the upper outside portion. The upper outside portion may preferably be substantially vertical and defines an outer vertical plane, wherein the first locking element protrudes from the outer vertical plane at least partially, preferably maximally 2 mm. For example, the upper outside portion above the first locking element defines a vertical plane and the lower outside portion beneath the first locking element defines another vertical plane, which are parallel but offset, with the vertical plane of the lower outside portion being located closer to the upward flank. This difference creates a relative large distance between the panels at the intersection between the inclined locking surface of the upward tongue and the lower outside portion, which allows for a larger upward angling or rotational movement of the upward tongue and thus for a potential larger closing or tension force exerted by the locking elements to improve the connection and waterproof properties of the panels.

The lower outside portion may be substantially vertical and the inclined locking surface or the lower portion and the lower outside portion enclose an angle between 100 and 175 degrees, in particular between 100 and 150 degrees, more in particular between 110 and 135 degrees. Such angle has proven to provide the best combination of locking and guiding properties. The angle enclosed by the upper contact surfaces and the inclined contact surfaces and the angle enclosed by the lower outside portion and the inclined locking surface or the lower portion may be within 20 degrees difference, and is preferably the same. This allows for a relative easy manufacture wherein the same or similar tooling may be used to mill both elements from a panel.

An outermost portion of the first locking element may be arranged at a horizontal level which is lower compared to the upward groove. This way, during the downward motion of the panels during coupling, the widest or outermost portion of the first locking element is encountered relatively late, which facilitates coupling of two panels.

Adjoining, and typically directly adjoining or directly below, the upper contact surfaces an inclined contact surface may be present. At the inclined surfaces the panels are in contact, to create a connection or seal between the panels. The inclination is preferably such that, looking at the downward tongue, the inclined surface extends outwardly and, looking at the upward flank, the inclined surface extends inwardly. The inclination angle makes it such that the downward tongue thus has a protruding portion and the upward flank has a recessed portion, which in coupled condition are in contact and thus provide a vertical locking effect. The inclination also creates a slight labyrinth, which improves the waterproof properties of the connection.

Adjoining, and typically directly adjoining or directly below, the inclined contact surface the downward tongue may comprise an outer surface. This outer surface may for instance be the outermost surface of the downward tongue, or the surface of the outer tongue the furthest from the downward flank. Similarly adjoining, and typically directly adjoining or directly below, the inclined contact surface the upward flank comprises an inner surface. Between the inner surface and the outer surface, a space is present. This space aims to prevent that any force exerted on or by the panels results in pushing the panels together anywhere else than at the upper contact surfaces and/or inclined contact surfaces. If the inner and outer surfaces would be in contact, they could prevent the upper contact surfaces to contact, which would be detrimental to the waterproof properties of the connection. At the top, at the upper contact surfaces and the inclined contact surfaces, the aim is thus to create a connection between the panels, whereas below these contact surfaces the aim is to avoid such connection.

The upper contact surfaces may at least partially be vertical and define an inner vertical plane, wherein the inclined contact surface of the downward tongue extends beyond the inner vertical plane, preferably by maximally 1 mm in horizontal direction, and wherein the inclined contact surface of the upward flank lies inward compared to the inner vertical plane. Such configuration is such that the downward tongue locally protrudes from the inner vertical plane, and the upward flank is locally recessed, wherein in coupled condition the inclined contact surfaces may grip behind each other to create a vertical locking effect. By limiting the horizontal extent of the protrusion, the downward tongue can still be coupled with a downward or vertical motion whilst providing the vertical locking effect. A portion of the downward tongue may thus extend beyond the inner vertical plane, which portion may be elongated with a larger vertical portion compared to the horizontal portion, wherein preferably the vertical portion is at least 3 times the horizontal portion. This allows for a relatively small horizontal portion, such that the panels can still be connected with a vertical or downward motion.

A portion of the downward tongue may thus extend beyond the inner vertical plane, wherein said portion may be substantially trapezium-shaped or wedge-shaped. Such shape allows that the portion, when under any locking, coupling or other force in the plane of the panels, is wedged into the space provided in the upward flank while also providing a robust portion able to withstand forces, to create a tight connection between the panels. This in turn improves the waterproof properties of the connection between the panels.

The inclined contact surfaces may both be arranged outside and/or adjoining the inner vertical plane, and are preferably completely arranged outside the inner vertical plane or located entirely on one side of the inner vertical plane. This allows for a relative simple construction which provides a tight connection between two panels. Preferably the upper contact surfaces, which define the vertical plane, directly transition into the inclined contact surfaces. In such configuration the connection, of the contact surfaces continue from the upper contact surfaces to the inclined contact surfaces, increasing the uninterrupted surface thus improving the connection between the panels and the waterproof properties of the connection.

In coupled condition a bottom of the downward tongue may contact the upper side of the upward groove at a groove contact surface, and wherein a gap is present between the first and second coupling parts, extending from the inclined contact surfaces to the groove contact surface. Such gap may be used to collect for instance dust or shavings from the panels, potentially created during coupling of two panels. Additionally such gap aims to prevent that any force exerted on or by the panels results in pushing the panels together anywhere else than at the upper contact surfaces and/or inclined contact surfaces. The groove contact surface is preferably mainly horizontal, and allows for forces exerted on the panel, and in particular on the connection between two panels, typically in downward direction by stepping on the panel, to be transferred to the subfloor or surface beneath the panels.

An upper surface of the upward tongue and an upper surface of the downward groove may, in coupled condition, be distanced from each other such that a gap is present between the two surfaces. Again, such gap aims to prevent that any force exerted on or by the panels results in pushing the panels together anywhere else than at the upper contact surfaces and/or inclined contact surfaces. An upward motion of the upward tongue may for instance result in a horizontal force which closes or tightens the connection between two panels, more in particular in so called closed groove locking connections. To allow this upward motion, the gap is provided between the upward tongue and the downward groove. The upper surface of the downward groove may for instance be formed by the bottom surface of a bridge portion connecting the downward tongue to the rest of the panel The upper contact surface and the inclined contact surface of the upward flank may mutually enclose a first angle, and the upper contact surface and the inclined contact surface of the downward tongue may mutually enclose a second angle, wherein the first and second angle are within 20 degrees difference. For example, the inclined contact surface of the upward flank may mutually enclose a first angle of 120 degrees, and the upper contact surface and the inclined contact surface of the downward tongue may mutually enclose a second angle of 125 degrees. The difference between the two angles is 5 degrees which is within 20 degrees as it is less than 20 degrees. By creating a difference between the angles, a configuration maybe provided wherein a wedging action may be achieved, to increase locking forces and waterproof properties in the connection. Pushing or wedging the locking elements into each other may result in increase in the locking forces or connections in the panels.

It is imaginable that the panel comprises a plurality of first edges and a plurality of second edges. This means that all embodiments of the first edge, as described above (and below), can be applied to a plurality of panel edges, and that all embodiments of the second edge, as described above (and below), can be applied to a plurality of other panel edges. It is also imaginable, and often preferable that the panel comprises at least one third edge and at least one opposite fourth edge, wherein said third edge comprises a third upper edge portion, wherein said fourth edge comprises a fourth upper edge portion; at least one third coupling part arranged on said third edge, and at least one fourth coupling part arranged on said opposite fourth edge, wherein the third coupling part of said panel and the fourth coupling part of another panel are arranged to be coupled to provide a locking of two coupled panels, such that a least a part of the third upper edge portion faces, in particular co-acts or is configured to co-act with, at least a part of the fourth upper edge portion to form a top seam in between the panels; wherein the third edge, in particular the third upper edge portion and/or the fourth edge, in particular the fourth upper edge portion, is provided with at least one expandable material layer which comprises at least one material configured to expand or swell upon contact with moisture. Preferably, the third coupling part and the fourth coupling part of another panel are arranged to be coupled by means of an angling down motion, also referred to as turning or rotary movement.

Preferably, the third coupling part comprises: a sideward tongue extending in a direction substantially parallel to the upper side of the core, at least one second downward flank lying at a distance from the sideward tongue, and a second downward groove formed between the sideward tongue and the second downward flank, and wherein the fourth coupling part comprises: a third groove configured for accommodating at least a part of the sideward tongue of the third coupling profile of an adjacent panel, said third groove being defined by an upper lip and a lower lip, wherein said lower lip is provided with an upward locking element, wherein the third coupling part and the fourth coupling part are configured such that two of such panels can be coupled to each other by means of a turning movement, wherein, in coupled condition: at least a part of the sideward tongue of a first panel is inserted into the third groove of an adjacent, second panel, and wherein at least a part of the upward locking element of said second panel is inserted into the second downward groove of said first panel.

To form a tight connection at the top seam, the panels may be in contact at the upper contact surfaces. Preferably these upper contact surfaces are plane parallel and extend vertically, to increase the contact surface. The upper contact surfaces are not necessarily the upper surfaces of the panels, it is for instance possible to provide the panels with a chamfered or bevelled top surface or a grout, which would provide a decorative function at the surface of the panels. Preferably the upper contact surfaces are the upper surfaces where two panels are in contact.

Preferably the panels, or the coupling parts of the panels, are configured such that they exert a certain locking or clamping force in coupled condition, forcing the panels towards each other. Such locking force can for instance be achieved by a pre-tension configuration or by slightly oversizing one coupling part compared to the other. In floor panels this creates a force in horizontal direction, or in the plane of the floor panel. This locking force preferably pushed the panels towards each other in the main plane of the panels, and thus pushes the upper contact surfaces together, wherein this pretension improves the connection between the panels and preferably creating a watertight seal at the top of the panels.

The panels according to the invention are for example at least partially made from magnesium oxide, or are magnesium oxide based. The panel according to the invention may comprise: a core provided with an upper side and a lower side, a decorative top structure (or top section) affixed, either directly or indirectly on said upper side of the core, wherein said core comprises: at least one composite layer comprising: at least one magnesium oxide (magnesia) and/or magnesium hydroxide based composition, in particular a magnesia cement. Particles, in particular cellulose and/or silicone based particles, may be dispersed in said magnesia cement. Optionally one or more reinforcement layers, such as glass fibre layers, may embedded in said composite layer. The core composition may also comprise magnesium chloride leading to a magnesium oxychloride (MOC) cement, and/or magnesium sulphate leading to magnesium oxysulphate (MOS) cement.

It has been found that the application of a magnesium oxide and/or magnesium hydroxide based composition, and in particular a magnesia cement, including MOS and MOC, significantly improves the inflammability (incombustibility) of the decorative panel as such.

Moreover, the relatively fireproof panel also has a significantly improved dimensional stability when subject to temperature fluctuations during normal use. Magnesia based cement is cement which is based upon magnesia (magnesium oxide), wherein cement is the reaction product of a chemical reaction wherein magnesium oxide has acted as one of the reactants. In the magnesia cement, magnesia may still be present and/or has undergone chemical reaction wherein another chemical bonding is formed, as will be elucidated below in more detail. Additional advantages of magnesia cement, also compared to other cement types, are presented below. A first additional advantage is that magnesia cement can be manufactured in a relatively energetically efficient, and hence cost efficient, manner. Moreover, magnesia cement has a relatively large compressive and tension strength. Another advantage of magnesia cement is that this cement has a natural affinity for—typically inexpensive—cellulose materials, such as plant fibres wood powder (wood dust) and/or wood chips; This not only improves the binding of the magnesia cement, but also leads a weight saving and more sound insulation (damping). Magnesium oxide when combined with cellulose, and optionally clay, creates magnesia cements that breathes water vapour; this cement does not deteriorate (rot) because this cement expel moisture in an efficient manner. Moreover, magnesia cement is a relatively good insulating material, both thermally and electrically, which makes the panel in particularly suitable for flooring for radar stations and hospital operating rooms. An additional advantage of magnesia cement is that it has a relatively low pH compared to other cement types, which all allows major durability of glass fibre either as dispersed particles in cement matrix and/or (as fiberglass) as reinforcement layer, and, moreover, enables the use other kind of fibres in a durable manner. Moreover, an additional advantage of the decorative panel is that it is suitable both for indoor and outdoor use.

As already addressed, the magnesia cement is based upon magnesium oxide and/or magnesium hydroxide. The magnesia cement as such may be free of magnesium oxide, dependent on the further reactants used to produce the magnesia cement. Here, it is, for example, well imaginable that magnesia as reactant is converted into magnesium hydroxide during the production process of the magnesia cement. Hence, the magnesia cement as such may comprise magnesium hydroxide. Typically, the magnesia cement comprises water, in particular hydrated water. Water is used as normally binder to create a strong and coherent cement matrix.

The magnesia based composition, in particular the magnesia cement, may comprise magnesium chloride ($MgCl_2$). Typically, when magnesia (MgO) is mixed with magnesium chloride in an aqueous solution, a magnesia cement will be formed which comprises magnesium oxychloride (MOC). The bonding phases are $Mg(OH)_2$, $5Mg(OH)_2 \cdot MgCl_2 \cdot 8H_2O$ (5-form), $3Mg(OH)_2 \cdot MgCl_2 \cdot 8H_2O$ (3-form), and $Mg_2(OH)ClCO_3 \cdot 3H_2O$. The 5-form is the preferred phase, since this phase has superior mechanical properties. Related to other cement types, like Portland cement, MOC has superior properties. MOC does not need wet curing, has high fire resistance, low thermal conductivity, good resistance to abrasion. MOC cement can be used with different aggregates (additives) and fibres with good adherence resistance. It also can receive different kinds of surface treatments. MOC develops high compressive strength within 48 hours (e.g. 8,000-10,000 psi). Compressive strength gain occurs early during curing—48-hour strength will be at least 80% of ultimate strength. The compressive strength of MOC is preferably situated in between 40 and 100 N/mm2. The flexural tensile strength is preferably 10-17 N/mm2. The surface hardness of MOC is preferably 50-250 N/mm2. The E-Modulus is preferably 1-3 $10^4$ N/mm2. Flexural strength of MOC is relatively low but can be significantly improved by the addition of fibres, in particular cellulose based fibres. MOC is compatible with a wide variety of plastic fibres, mineral fibres (such as basalt fibres) and organic fibres such as bagasse, wood fibres, and hemp. MOC used in the panel according to the invention may be enriched by one or more of these fibre types. MOC is non-shrinking, abrasion and acceptably wear resistant, impact, indentation and scratch resistant. MOC is resistible to heat and freeze-thaw cycles and does not require air entrainment to improve durability. MOC has, moreover, excellent thermal conductivity, low electrical conductivity, and excellent bonding to a variety of substrates and additives, and has acceptable fire resistance properties. MOC is less preferred in case the panel is to be exposed to relatively extreme weather conditions (temperature and humidity), which affect both setting properties but also the magnesium oxychloride phase development. Over a period of time, atmospheric carbon dioxide will react with magnesium oxychloride to form a surface layer of $Mg_2(OH)ClCO_3 \cdot 3H_2O$. This layer serves to slow the leaching process. Eventually additional leaching results in the formation of hydromagnesite, $4MgO \cdot 3CO_3 \cdot 4H_2O$, which is insoluble and enables the cement to maintain structural integrity.

The magnesium based composition, and in particular the magnesia cement, may be based upon magnesium sulphate, in particular heptahydrate sulphate mineral epsomite ($MgSO_4 \cdot 7H_2O$). This latter salt is also known as Epsom salt. In aqueous solution MgO reacts with MgSO4, which leads to magnesium oxysulfate cement (MOS), which has very good binding properties. In MOS, $5Mg(OH)_2 \cdot MgSO4 \cdot 8H2O$ is the most commonly found chemical phase. Although MOS is not as strong as MOC, MOS is better suited for fire resistive uses, since MOS start to decompose at temperatures more than two times higher than MOC giving longer fire protection. Moreover, their products of decomposition at elevated temperatures are less noxious (sulfur dioxide) than those of oxychloride (hydrochloric acid) and, in addition, less corrosive. Furthermore, weather conditions (humidity, temperature, and wind) during application are not as critical with MOS as with MOC. The mechanical strength of MOS cement depends mainly on the type and relative content of the crystal phases in the cement. It has been found that four basic magnesium salts that can contribute to the mechanical strength of MOS cement exist in the ternary system $MgO—MgSO_4—H_2O$ at different temperatures between of 30 and 120 degrees Celsius $5Mg(OH)_2—MgSO_4 \cdot 3H_2O$ (513 phase), 3 $Mg(OH)_2—MgSO_4$-$8H_2O$ (318 phase), $Mg(OH)_2 \cdot 2MgSO_4 \cdot 3H_2O$ (123 phase), and $Mg(OH)_2—MgSO_4 \cdot 5H_2O$ (115 phase). Normally, the 513 phase and 318 phase could only be obtained by curing cement under saturated steam condition when the molar ratio of MgO and MgSO4 was fixed at (approximately) 5:1. It has been found that the 318 phase is significantly contributing to the mechanical strength and is stable at room temperature, and is therefore preferred to be present in the MOS applied. This also applies to the 513 phase. The 513 phase typically has a (micro)structure comprising a needle-like structure. This can be verified by means of SEM analysis. The magnesium oxysulfate ($5Mg(OH)2 \cdot MgSO4 \cdot 3H2O$) needles may be formed substantially uniform, and will typically have a length of 10-15 μm and a diameter of 0.4-1.0 μm. When it is referred to a needle-like structure, also a flaky-structure and/or a whisker-structure can be meant. In practice, it does not seem feasible to obtain MOS comprising more than 50% 513 or 318 phase, but by adjusting the crystal phase composition can be applied to improve the mechanical strength of MOS. Preferably, the magnesia cement comprises at least 10%, preferably at least 20% and more preferably at least 30% of the $5Mg(OH)_2 \cdot MgSO_4 \cdot 3H_2O$ (513-phase). This preferred embodiment will provide a magnesia cement having sufficient mechanical strength for use in the core layer of a floor panel.

The crystal phase of MOS is adjustable by modifying the MOS by using an organic acid, preferably citric acid and/or by phosphoric acid and/or phosphates. During this modification new MOS phases can obtained, which can be expressed by $5Mg(OH)2 \cdot MgSO4 \cdot 5H2O$ (515 phase) and $Mg(OH)_2 \cdot MgSO_4 \cdot 7H_2O$ (517-phase). The 515 phase is obtainable by modification of the MOS by using citric acid. The 517 phase is obtainable by modification of the MOS by using phosphoric acid and/or phosphates ($H_3PO_4$, $KH_2PO_4$, $K_3PO_4$ and $K_2HPO_4$). These 515 phase and 517 phase can be determined by chemical element analysis, wherein SEM analysis proves that the microstructure both of the 515 phase and the 517 phase is a needle-like crystal, being insoluble in water. In particular, the compressive strength and water resistance of MOS can be improved by the additions of citric acid. Hence, it is preferred that MOS, if applied in the panel according to the invention, comprises 5Mg(OH)2·MgSO4·5H2O (515 phase) and/or $Mg(OH)_2 \cdot MgSO_4 \cdot 7H_2O$ (517-phase). As addressed above, adding phosphoric acid and phosphates can extend the setting time and improve the compressive strength and water resistance of MOS cement by changing the hydration process of MgO and the phase composition. Here, phosphoric acid or phosphates ionize in solution to form $H_2PO_4^-$, $HPO_4^{2-}$, and/or $PO_4^{3-}$, wherein these anions adsorb onto $[Mg(OH)(H_2O)^x]^+$ to inhibit the formation of $Mg(OH)_2$ and further promote the generation of a new magnesium sub-sulfate phase, leading to the compact structure, high mechanical strength and good water resistance of MOS cement. The improvement produced by adding phosphoric acid or phosphates to MOS cement follows the order of $H_3PO_4$=$KH_2PO$+>>$K_2HPO_4$>>$K_3PO_4$. MOS has better volumetric stability, less shrinkage, better binding properties and lower corrosivity under a significantly wider range of weather conditions than MOC, and could therefore be preferred over MOS. The density of MOS typically varies from 350 to 650 kg/m3. The flexural tensile strength is preferably 1-7 N/mm2.

The magnesium cement composition preferably comprises one or more silicone based additives. Various silicone based additives can be used, including, but not limited to, silicone oils, neutral cure silicones, silanols, silanol fluids, silicone (micro)spheres, and mixtures and derivatives thereof. Silicone oils include liquid polymerized siloxanes with organic side chains, including, but not limited to, polymethylsiloxane and derivatives thereof. Neutral cure silicones include silicones that release alcohol or other volatile organic compounds (VOCs) as they cure. Other silicone based additives and/or siloxanes (e.g., siloxane polymers) can also be used, including, but not limited to, hydroxyl (or hydroxy) terminated siloxanes and/or siloxanes terminated with other reactive groups, acrylic siloxanes, urethane siloxanes, epoxy siloxanes, and mixtures and derivatives thereof. As detailed below, one or more crosslinkers (e.g., silicone based crosslinkers) can also be used. The viscosity of the one or more silicone based additives (e.g., silicone oil, neutral cure silicone, silanol fluid, siloxane polymers, etc.) may be about 100 cSt (at 25° C.), which is called low-viscous. In alternative embodiments, the viscosity of the one or more silicone based additives (e.g., silicone oil, neutral cure silicone, silanol fluid, siloxane polymers, etc.) is between about 20 cSt (25° C.) and about 2000 cSt (25° C.). In other embodiments, the viscosity of the one or more silicone based additives (e.g., silicone oil, neutral cure silicone, silanol fluid, siloxane polymers, etc.) is between about 100 cSt (25° C.) and about 1250 cSt (25° C.). In other embodiments, the viscosity of the one or more silicone based additives (e.g., silicone oil, neutral cure silicone, silanol fluid, siloxane polymers, etc.) is between about 250 cSt (25° C.) and 1000 cSt (25° C.). In yet other embodiments, the viscosity of the one or more silicone based additives (e.g., silicone oil, neutral cure silicone, silanol fluid, siloxane polymers, etc.) is between about 400 cSt (25° C.) and 800 cSt (25° C.). And in particular embodiments, the viscosity of the one or more silicone based additives (e.g., silicone oil, neutral cure silicone, silanol fluid, siloxane polymers, etc.) is between about 800 cSt (25° C.) and about 1250 cSt (25° C.). One or more silicone based additives having higher and/or lower viscosities can also be used. For example, in further embodiments, the viscosity of the one or more silicone based additives (e.g., silicone oil, neutral cure silicone, silanol fluid, siloxane polymers, etc.) is between about 20 cSt (25° C.) and about 200,000 (25° C.) cSt, between about 1,000 cSt (25° C.) and about 100,000 cSt (25° C.), or between about 80,000 cSt (25° C.) and about 150,000 cSt (25° C.). In other embodiments, the viscosity of the one or more silicone based additives (e.g., silicone oil, neutral cure silicone, silanol fluid, siloxane polymers, etc.) is between about 1,000 cSt (25° C.) and about 20,000 cSt (25° C.), between about 1,000 cSt (25° C.) and about 10,000 cSt (25° C.), between about 1,000 cSt (25° C.) and about 2,000 cSt (25° C.), or between about 10,000 cSt (25° C.) and about 20,000 cSt (25° C.). In yet other embodiments, the viscosity of the one or more silicone based additives (e.g., silicone oil, neutral cure silicone, silanol fluid, siloxane polymers, etc.) is between about 1,000 cSt (25° C.) and about 80,000 cSt (25° C.), between about 50,000 cSt (25° C.) and about 100,000 cSt (25° C.), or between about 80,000 cSt (25° C.) and about 200,000 cSt (25° C.). And in still further embodiments, the viscosity of the one or more silicone based additives (e.g., silicone oil, neutral cure silicone, silanol fluid, siloxane polymers, etc.) is between about 20 cSt (25° C.) and about 100 cSt (25° C.). Other viscosities can also be used as desired.

In a preferred embodiment, the magnesium cement composition, in particular the magnesium oxychloride cement composition, comprises a single type of silicone based additive. In other embodiments, a mixture of two or more types of silicone based additives are used. For example, in some embodiments, the magnesium oxychloride cement composition can include a mixture of one or more silicone oils and neutral cure silicones. In particular embodiments, the ratio of silicone oil to neutral cure silicone can be between about 1:5 and about 5:1, by weight. In other such embodiments, the ratio of silicone oil to neutral cure silicone can be between about 1:4 and about 4:1, by weight. In other such embodiments, the ratio of silicone oil to neutral cure silicone can be between about 1:3 and about 3:1, by weight. In yet other such embodiments, the ratio of silicone oil to neutral cure silicone can be between about 1:2 and about 2:1, by weight. In further such embodiments, the ratio of silicone oil to neutral cure silicone can be about 1:1, by weight.

It is imaginable that one or more crosslinkers are used in the magnesia cement. In some embodiments, the crosslinkers are silicone based crosslinkers. Exemplary crosslinkers include, but are not limited to, methyltrimethoxysilane, methyltriethoxysilane, methyltris (methylethylketoximino)silane and mixtures and derivatives thereof. Other crosslinkers (including other silicone based crosslinkers) can also be used. In some embodiments, the magnesium oxychloride cement composition comprises one or more silicone based additives (e.g., one or more silanols and/or silanol fluids) and one or more crosslinkers. The ratio of one or more silicone based additives (e.g., silanols and/or silanol fluids) to crosslinker can be between about 1:20 and about 20:1, by weight, between about 1:10 and about 10:1 by weight, or between about 1:1 and about 10:1, by weight.

The magnesium (oxychloride) cement compositions comprising one or more silicone based additives may exhibit reduced sensitivity to water as compared to traditional magnesium (oxychloride) cement compositions. Further, in some embodiments, the magnesium (oxychloride) cement compositions comprising one or more silicone based additives may exhibit little or no sensitivity to water. The magnesium (oxychloride) cement compositions comprising one or more silicone based additives can further exhibit hydrophobic and water resistant properties.

Also, the magnesium (oxychloride) cement compositions comprising one or more silicone based additives can exhibit improved curing characteristics. For example, magnesium (oxychloride) cement compositions cure to form various reaction products, including $3Mg(OH)_2 \cdot MgCl_2 \cdot 8H2O$ (phase 3) and $5Mg(OH)_2 \cdot MgCl_2 \cdot 8H_2O$ (phase 5) crystalline structures. In some situations, higher percentages of the $5Mg(OH)_2 \cdot MgCl_2 \cdot 8H_2O$ (phase 5) crystalline structure is preferred. In such situations, the addition of one or more silicone based additives to the magnesium oxychloride cement compositions can stabilize the curing process which can increase the percentage yield of $5Mg(OH)_2 \cdot MgCl_2 \cdot 8H2O$ (phase 5) crystalline structures. For example, in some embodiments, the magnesium oxychloride compositions comprising one or more silicone based additives can cure to form greater than 80% $5Mg(OH)_2 \cdot MgCl_2 \cdot 8H_2O$ (phase 5) crystalline structures. In other embodiments, the magnesium oxychloride compositions comprising one or more silicone based additives can cure to form greater than 85% $5Mg(OH)_2 \cdot MgCl_2 \cdot 8H_2O$ (phase 5) crystalline structures. In yet other embodiments, the magnesium oxychloride compositions comprising one or more silicone based additives can cure to form greater than 90% $5Mg(OH)_2 \cdot MgCl2 \cdot 8H2O$ (phase 5) crystalline structures. In yet other embodiments, the magnesium oxychloride compositions comprising one or more silicone based additives can cure to form greater than 95% $5Mg(OH)_2 \cdot MgCl_2 \cdot 8H_2O$ (phase 5) crystalline structures. In yet other embodiments, the magnesium oxychloride compositions comprising one or more silicone based additives can cure to form greater than 98% $5Mg(OH)_2 \cdot MgCl_2 \cdot 8H_2O$ (phase 5) crystalline structures. In yet other embodiments, the magnesium oxychloride compositions comprising one or more silicone based additives can cure to form about 100% $5Mg(OH)_2 \cdot MgCl_2 \cdot 8H_2O$ (phase 5) crystalline structures.

Furthermore, the magnesium (oxychloride) cement compositions comprising one or more silicone based additives can also exhibit increased strength and bonding characteristics. If desired, the magnesium (oxychloride) cement compositions comprising one or more silicone based additives can also be used to manufacture magnesium (oxychloride) cement or concrete structures that are relatively thin. For example, the magnesium (oxychloride) cement compositions comprising one or more silicone based additives can be used to manufacture cement or concrete structures or layers having thicknesses of less than 8 mm, preferably less than 6 mm.

For realizing the coupling between the coupling part, temporary deformation of the coupling part(s) may be desired and/or even required, as a result of which it is beneficial to mix magnesium oxide and/or magnesium hydroxide and/or magnesium chloride and/or magnesium sulphate with one or more silicone based additives, since this leads to an increased a degree of flexibility and/or elasticity. For example, in some embodiments, cement and concrete structures formed using the magnesium oxychloride cement compositions can bend or flex without cracking or breaking.

The magnesium (oxychloride) cement compositions comprising one or more silicone based additives can further comprise one or more additional additives. The additional additives can be used to enhance particular characteristics of the composition. For example, in some embodiments, the additional additives can be used to make the structures formed using the disclosed magnesium oxychloride cement compositions look like stone (e.g., granite, marble, sandstone, etc.). In particular embodiments, the additional additives can include one or more pigments or colorants. In other embodiments, the additional additives can include fibres, including, but not limited to, paper fibres, wood fibres, polymeric fibres, organic fibres, and fiberglass. The magnesium oxychloride cement compositions can also form structures that are UV stable, such that the colour and/or appearance is not subject to substantial fading from UV light over time. Other additives can also be included in the composition, including, but not limited to plasticizers (e.g., polycarboxylic acid plasticizers, polycarboxylate ether-based plasticizers, etc.), surfactants, water, and mixtures and combinations thereof. As indicated above, the magnesium oxychloride cement composition, if applied, can comprise magnesium oxide (MgO), aqueous magnesium chloride ($MgCl_2$ (aq)), and one or more silicone based additives. Instead of aqueous magnesium chloride ($MgCl_2$) magnesium chloride ($MgCl_2$) powder can also be used. For example, magnesium chloride ($MgCl_2$) powder can be used in combination with an amount of water that would be equivalent or otherwise analogous to the addition of aqueous magnesium chloride ($MgCl_2$ (aq)).

In certain embodiments, the ratio of magnesium oxide (MgO) to aqueous magnesium chloride ($MgCl_2$ (aq)), if applied, in the magnesium oxychloride cement composition can vary. In some of such embodiments, the ratio of magnesium oxide (MgO) to aqueous magnesium chloride ($MgCl_2$ (aq)) is between about 0.3:1 and about 1.2:1, by weight. In other embodiments, the ratio of magnesium oxide (MgO) to aqueous magnesium chloride ($MgCl_2$ (aq)) is between about 0.4:1 and about 1.2:1, by weight. And in yet other embodiments, the ratio of magnesium oxide (MgO) to aqueous magnesium chloride ($MgCl_2$ (aq)) is between about 0.5:1 and about 1.2:1, by weight.

The aqueous magnesium chloride ($MgCl_2$ (aq)) can be described as (or otherwise derived from) a magnesium chloride brine solution. The aqueous magnesium chloride ($MgCl_2$ (aq)) (or magnesium chloride brine) can also include relatively small amounts of other compounds or substances, including but not limited to, magnesium sulphate, magnesium phosphate, hydrochloric acid, phosphoric acid, etcetera.

In a preferred embodiment the amount of the one or more (liquid) silicone based additives within the magnesium oxychloride cement composition can be defined as the ratio of silicone based additives to magnesium oxide (MgO). For example, in some embodiments, the weight ratio of silicone based additives to magnesium oxide (MgO), is between 0.06 and 0.6.

Preferably, It is also imaginable, and even favourable, to incorporate in the core layer at least one oil, such as linseed oil or silicon oil. This renders the magnesium based core layer and/or thermoplastic based core layer more flexibility and reduced risk of breakage. Instead of or in addition to oil it is also imaginable to incorporate in the core layer one or more water-soluble polymers or polycondensed (synthetic) resins, such as polycarboxylic acid. This leads to the advantage that during drying/curing/setting the panel will not shrink which prevents the formation of cracks, and moreover provides the core layer, after drying/curing/setting, a more hydrophobic character, which prevents penetration of water (moisture) during subsequent storage and use.

It is imaginable that the core layer comprises polycaprolactone (PCL). This biodegradable polymer is especially preferred as this has been found to be made to melt by the exothermic reaction of the reaction mixture. It has a melting point of ca. 60° C. The PCL may be low density or high density. The latter is especially preferred as it produces a stronger core layer. Instead of, or in addition to, other polymers may be used, preferably a polymer chosen from the group consisting of: other poly(lactic-co-glycolic acid) (PLGA), poly(lactic acid) (PLA), poly(glycolic acid) (PGA), the family of polyhydroxyalkanoates (PHA), polyethylene glycol (PEG), polypropylene glycol (PPG), polyesteramide (PEA), poly(lactic acid-co-caprolactone), poly (lactide-co-trimethylene carbonate), poly(sebacic acid-co-ricinoleic acid) and a combination thereof.

Alternatively, the panel, in particular the core layer, may at least partly be made of PVC, PET, PP, PS or (thermoplastic) polyurethane (PUR). PS may be in the form of expanded PS (EPS) in order to further reduce the density of the panel, which leads to a saving of costs and facilitates handling of the panels. Preferably, at least a fraction of the polymer used may be formed by recycled thermoplastic, such a recycled PVC or recycled PUR. Recycled PUR may be made based on recyclable polymers, such as based on recyclable PET. PET can be recycled chemically by using glycolysis or depolymerisation of PET into monomers or oligomers, and subsequently into polyurethane polyols in the end. It is also imaginable that rubber and/or elastomeric parts (particles) are dispersed within at least one composite layer to improve the flexibility and/or impact resistance at least to some extent. It is conceivable that a mix of virgin and recycled thermoplastic material is used to compose at least a part of the core. Preferably, in this mix, the virgin thermoplastic material and the recycled thermoplastic material is basically the same. For example, such a mix can be entirely PVC-based or entirely PUR-based. The core may be solid or foamed, or both in case the core is composed of a plurality of parts/layers.

It may be advantageous in case the core layer comprises porous granules, in particular porous ceramic granules. Preferably the granules have a plurality of micropores of an average diameter of from 1 micron to 10 micron, preferably from 4 to 5 micron. That is, the individual granules preferably have micropores. Preferably, the micropores are interconnecting. They are preferably not confined to the surface of the granules but are found substantially throughout the cross-section of the granules. Preferably, the size of the granules is from 200 micron to 900 micron, preferably 250 micron to 850 micron, especially 250 to 500 micron or 500 to 850 micron. Preferably, at least two different sizes of granules, most preferably two, are used. Preferably, small and/or large granules are used. The small granules may have a size range of 250 to 500 micron. Preferably the large granules have a diameter of 500 micron to 850 micron. The granules may each be substantially of the same size or of two or more predetermined sizes. Alternatively, two or more distinct size ranges may be used with a variety of different sized particles within each range. Preferably two different sizes or ranges of sizes are used. Preferably, the granules each comprise a plurality of microparticles, substantially each microparticle being partially fused to one or more adjacent microparticles to define a lattice defining the micropores. Each microparticle preferably has an average size of 1 micron to 10 micron, with an average of 4 to 5 micron. Preferably, the average size of the micropores is from 2 to 8 micron, most preferably 4 to 6 micron. The micropores may be irregular in shape. Accordingly, the size of the micropores, and indeed the midi-pores referred to below, are determined by adding the widest diameter of the pore to the narrowest diameter of the pore and dividing by 2. Preferably, the ceramic material is evenly distributed throughout a cross-section of the core layer, that is substantially without clumps of ceramic material forming. Preferably, the microparticles have an average size of at least 2 micron or 4 micron and/or less than 10 micron or less than 6 micron, most preferably 5 to 6 micron. This particle size range has been found to allow the controlled formation of the micropores.

The granules may also comprise a plurality of substantially spherical midi-pores having an average diameter of 10 to 100 micron. They substantially increase the total porosity of the ceramic material without compromising the mechanical strength of the materials. The midi-pores are preferably interconnected via a plurality of micropores. That is, the midi-pores may be in fluid connection with each other via micropores. The average porosity of the ceramic material itself is preferably at least 50%, more preferably greater than 60%, most preferably 70 to 75% average porosity. The ceramic material used to produce the granules may be any (non-toxic) ceramic known in the art, such as calcium phosphate and glass ceramics. The ceramic may be a silicate, though is preferably a calcium phosphate, especially [alpha]- or [beta]-tricalcium phosphate or hydroxyapatite, or mixtures thereof. Most preferably, the mixture is hydroxyapatite and [beta]-tricalcium phosphate, especially more than 50% w/w [beta]-tricalcium, most preferably 85% [beta]-tricalcium phosphate and 15% hydroxyapatite. Most preferably the material is 100% hydroxyapatite. Preferably the cement composition or dry premix comprises 15 to 30% by weight of granules of the total dry weight of the composition or premix.

The porous particles could lead to a lower average density of the core layer and hence to a reduction of weight which is favourable from an economic and handling point of view. Moreover, the presence of porous particles in the core layer typically leads to, at least some extent, an increased porosity of a porous top surface and bottom surface of the core layer, which is beneficial for attaching an additional layer to the top surface and/or bottom surface of the core layer, such as, for example, a primer layer, an (initially liquid) adhesive layer, or another decorative or functional layer. Often, these layers are initially applied in a liquid state, wherein the pores allow the liquid substance to be sucked up (to permeate) into the pores, which increases the contact surface area between the layers and hence improves the bonding strength between said layers.

The panels may comprise a layered structure, comprising for instance a central core (or core layer) and at least one decorative top section, directly or indirectly affixed to said core layer, or integrated with said core layer, wherein the top section defines a top surface of the panel. The top section preferably comprises at least one decorative layer affixed, either directly or indirectly, to an upper surface of the core layer. The decorative layer may be a printed layer, such as a printed PVC layer, a printed PU layer or a printed paper layer, and/or may be covered by at least one protective (top) layer covering said decorative layer. The protective layer also makes part of the decorative top section. The presence of a print layer and/or a protective layer could prevent the tile to be damaged by scratching and/or due to environmental factors such as UV/moisture and/or wear and tear. The print layer may be formed by a film onto which a decorative print is applied, wherein the film is affixed onto the substrate layer and/or an intermediate layer, such as a primer layer, situated in between the substrate layer and the decorative layer. The print layer may also be formed by at least one ink layer which is directly applied onto a top surface of the core layer, or onto a primer layer applied onto the substrate layer. The panel may comprise at least one wear layer affixed, either directly or indirectly, to an upper surface of the decorative layer. The wear layer also makes part of the decorative top section. Each panel may comprise at least one lacquer layer affixed, either directly or indirectly, to an upper surface of the decorative layer, preferably to an upper surface of the wear layer.

The lower side (rear side) of the core (layer(s)) may also constitute the lower side (rear side) of the panel as such. However, it is thinkable, and it may even be preferable, that the panel comprises a backing layer, either directly or indirectly, affixed to said lower said of the core. Typically, the backing layer acts as balancing layer in order to stabilize the shape, in particular the flatness, of the panel as such. Moreover, the backing layer typically contributes to the sound dampening properties of the panel as such. As the backing layer is typically a closed layer, the application of the backing layer to the lower side of the core will cover the core grooves at least partially, and preferably entirely. Here, the length of each core groove is preferably smaller than the length of said backing layer. The backing layer may be provided with cut-out portions, wherein at least a part of said cut-out portions overlap with at least one core groove. The at least one backing layer is preferably at least partially made of a flexible material, preferably an elastomer. The thickness of the backing layer typically varies from about 0.1 to 2.5 mm. Non-limiting examples of materials of which the backing layer can be at least partially composed are polyethylene, cork, polyurethane, polyvinylchloride, and ethylene-vinyl acetate. Optionally, the backing layer comprises one or more additives, such as fillers (like chalk), dyes, resins and/or one of more plasticizers. In a particular embodiment, the backing layer is at least partially made of a composite of ground (or shaved) cork particles bound by resin. Instead of cork other tree related products, such as wood, may be used. The thickness of a polyethylene backing layer is for example typically 2 mm or smaller. The backing layer may either be solid or foamed. A foamed backing layer may further improve the sound dampening properties. A solid backing layer may improve the desired balancing effect and stability of the panel.

The inside of the upward tongue and the inside of the downward tongue may be in contact in coupled condition, to transfer forces between them, in particular from the upward tongue to the downward tongue. The insides of the tongues may be in contact at tongue contact surfaces, wherein the tongue contact surfaces may be inclined. The inclination may be such that a portion of the inside of the upward tongue is inclined towards the flank, such that a tangent line from the tongue contact surface intersects with the inner vertical plane above the tongue contact surface. Alternatively the inclination may be such that a portion of the inside of the tongue is inclined away from the upward flank, such that a tangent line from the tongue contact surface intersects with the inner vertical plane below the tongue contact surface. These are closed groove and open groove systems respectively. Closed groove systems provide for an improved locking, but are more difficult to couple, whereas open groove systems are easier to couple but do not provide the additional vertical locking of a closed groove system.

The first and second coupling parts are arranged on opposite sides of the panel. The panel is for instance rectangular or parallelogrammatic and/or elongated, and the first and second coupling parts may be arranged on both opposite sides (so on all four sides) of such panel. It is also possible to provide the first and second coupling parts on one pair of opposite sides only, and provide other coupling parts, such as angling down coupling parts with a sideward tongue and a sideward groove on the other pair of opposite sides.

The invention further relates to a covering, comprising multiple interconnected panels according to the present invention.

The invention also relates to a method of manufacturing a panel according to the invention, comprising the steps of: A) providing at least a first edge and an opposite second edge of a semi-finished panel with a first coupling part and a second coupling part respectively; B) applying at least one expandable material layer, comprising at least one material configured to expand or swell upon contact with moisture, onto at least one upper edge portion of at least one profiled edge. Preferably, during step B) at least one expandable material layer is applied by means of spraying or printing, preferably digital printing. Preferably, during step B) at least one expandable material layer is applied by means of transfer printing. Preferably, during step B) a laminate of a decorative layer and at least one expandable layer is applied by means of transfer printing. Preferably, during step B) a transfer foil comprising at least one transferrable, expandable material layer is used, wherein the transfer foil is preferably removed after transfer of the at least one expandable material layer to the upper edge portion.

The invention further relates to a transfer foil of the type which can be applied for covering at least a part of at least upper edge portion of a panel according to the invention, in particular by applying the method according to the invention, wherein the transfer foil comprises at least one transferable, expandable material layer which comprises at least one material configured to expand or swell upon contact with moisture. The transfer foil typically comprises a sheet of a polymeric carrier such as polyester, acetate or cellophane, onto which, preferably, a release coating such as a wax is applied. A lacquer or varnish is preferably overlayed to improve the resistance of the transfer foil. The transferable expandable material layer (and optional further layers, such as a decorative and/or coloured layer) are deposited, printed, or painted onto the coated carrier. Preferably an adhesive coating is applied to the transferable layer(s) to facilitate the transfer. The transfer foil is placed against a panel edge to be provided with the transferable layer(s), and a die is pressed against the foil to transfer the expandable layer and possible other layers onto the panel edge, either by pressure or heat and pressure. If an decorative design is desired on the panel edge, this design can be placed on the panel edge either before or after transfer of the expandable layer(s). Typically, a careful registration is required to ensure proper alignment of the layer(s) with respect to the panel edge.

Preferred embodiments of the invention are set out in the non-limitative set of clauses presented below.

CLAUSES

1. Panel (1), in particular a floor panel, more in particular a decorative floor panel, comprising:

a. at least one first edge and at least one opposite second edge, wherein said first edge comprises a first upper edge portion, wherein said second edge comprises a second upper edge portion;

b. at least one first coupling part (2) arranged on said first edge, and at least one second coupling part (3) arranged on said opposite second edge, wherein the first coupling part (2) of said panel and the second coupling part (3) of another panel (1) are arranged to be coupled to provide a locking of two coupled panels (1), such that a least a part of the first upper edge portion faces, in particular co-acts or is configured to co-act with, at least a part of the second upper edge portion to form a top seam in between the panels;

c. wherein at least a part of at least one upper edge portion is provided with at least one expandable material layer which comprises at least one material configured to expand or swell upon contact with moisture.

2. Panel (1) according to clause 1, wherein the said at least one expandable material layer is positioned such that during expanding or swelling of said expandable material layer upon contact with moisture, the top seam is tightened, preferably substantially closed, more preferably substantially closed in a waterproof manner.

3. Panel (1) according to clause 1 or 2, wherein the panel comprises a core, wherein the expandable material layer is affixed, either directly or indirectly, onto said core.

4. Panel (1) according to one of the foregoing clauses, wherein, in coupled condition of two adjacent panels, the at least one expandable material layer provided at least one upper edge portion of a panel is at least partially covered by an opposing upper edge portion of an adjacent panel.

5. Panel (1) according to one of the foregoing clauses, wherein, in coupled condition of two adjacent panels, the at least one expandable material layer provided at least one upper edge portion of a panel is at least partially left uncovered by an opposing upper edge portion of an adjacent panel.

6. Panel (1) according to one of the foregoing clauses, wherein the at least one expandable material layer provided is partially covered by at least one protective layer, preferably a water impermeable protective layer, and wherein an exposed portion of said expandable material layer is in direct contact with the surrounding atmosphere.

7. Panel (1) according to one of the foregoing clauses, wherein, the first one upper edge portion is provided with at least one first expandable material layer and wherein the second upper edge portion is provided with at least one second expandable material layer.

8. Panel (1) according to one of the foregoing clauses, wherein at least one upper edge portion is provided with a plurality of expandable material layers, wherein each expandable material layer comprises at least one material configured to expand or swell upon contact with moisture.

9. Panel (1) according to one of the foregoing clauses, wherein each upper edge portion is provided with at least one expandable material layers, wherein, in coupled condition of adjacent panels, expendable material layers of opposing upper edge portions are configured to co-act with each other.

10. Panel (1) according to one of the foregoing clauses, wherein at least one expandable material layer is formed by a material strip.

11. Panel (1) according to one of the foregoing clauses, wherein at least one expandable material layer follows the shape of a curved and/or angled portion of a coupling part.

12. Panel (1) according to one of the foregoing clauses, wherein the thickness of at least one expandable material layer varies in lateral direction, and preferably decreases in a direction away from an outer end of the panel edge.

13. Panel according to one of the foregoing clauses, wherein the thickness of the material layer (9) is between 10 and 1000 micron, in particular between 20 and 500 micron.

14. Panel (1) according to one of the foregoing clauses, wherein at least one upper edge portion is provided with a channel-shaped recessed portion extending along the length of one said upper edge portion, wherein the recessed portion is configured to adjoin an upper edge portion of an adjacent panel, in coupled condition of two panels.

15. Panel (1) according to clause 14, wherein, in coupled condition of two panels, the adjoining upper edges enclose a groove, such as a U-shaped groove or a V-shaped groove, preferably representing a grout line.

16. Panel (1) according to clause 14 or 15, wherein a bottom portion of the recessed portion, connecting to a side wall of the upper edge portion, is provided with at least one expandable material layer.

17. Panel (1) according to one of clauses 14-16, wherein at least one upper edge portion provided with channel-shaped recessed portion comprises a vertical wall part positioned below and connecting to said channel-shaped recessed portion, wherein both at least a part of the channel-shaped recessed portion and at least a part of the vertical wall part are covered by at least one expandable material layer.

18. Panel (1) according to clause 17, wherein the thickness of the expandable material layer section covering the vertical wall part is smaller than the thickness of the expandable material layer section covering the channel-shaped recessed portion.

19. Panel (1) according to one of clauses 14-18, wherein each of the first upper edge portion and the second upper edge portion is provided with a channel-shaped recessed portion extending along the length of one said upper edge portion, wherein the recessed portions of adjacent panels are configured to connect to each other to form a single groove.

20. Panel (1) according to one of clauses 14-18, wherein the first upper edge portion is provided with a channel-shaped recessed portion extending along the length of one said upper edge portion, and wherein the second upper edge portion comprises a substantially vertical wall part configured to connect to recessed portion of the first upper edge portion of an adjacent panel.

21. Panel (1) according to one of the foregoing clauses, wherein at least one upper edge portion comprises a bevel connecting an upper side of the panel and a side wall of the panel, wherein, preferably, said bevel has an angle of inclination of about 12 degrees to about 30 degrees relative to said upper side of the panel.

22. Panel according to one of the foregoing clauses, wherein the expandable material is at least partially enclosed by a core of the panel and a decorative layer of the panel.

23. Panel according to one of the foregoing clauses, wherein the material layer (9) comprises at least one hydrogel-forming water-swellable polymer.

24. Panel according to one of the foregoing clauses, wherein the expandable material layer (9), in swollen or expanded state, forms a water-impermeable barrier, a waterproof barrier and/or a water-resistant barrier.

25. Panel according to any of the foregoing clauses, wherein the expandable material layer (9) is coloured, wherein preferably the material layer (9) is coloured to mimic concrete or panel grout lines.
26. Panel according to one of the foregoing clauses, wherein the first coupling part (2) and the second coupling part (3) of another panel are arranged to be coupled by means of a downward motion; wherein the first coupling part (2) comprises an upward tongue (12), at least one upward flank (13) lying at a distance from the upward tongue and an upward groove (14) formed in between the upward tongue (12) and the upward flank (13), wherein the upward groove is adapted to receive at least a part of a downward tongue of a second coupling part of another panel, wherein the side of the upward tongue facing towards the upward flank is the inside of the upward tongue and the side of the upward tongue facing away from the upward flank is the outside of the upward tongue; wherein the second coupling part comprises a downward tongue (15), at least one downward flank (16) lying at a distance from the downward tongue, and a downward groove (17) formed in between the downward tongue and the downward flank, wherein the downward groove is adapted to receive at least a part of an upward tongue of a first coupling part of another panel, wherein the side of the downward tongue facing towards the downward flank is the inside of the downward tongue and the side of the downward tongue facing away from the downward flank is the outside of the downward tongue.
27. Panel according to clause 26, wherein the outside of the downward tongue and the upward flank both comprise an upper contact surface (10) near or at or adjoining or towards a top side of the panel, which upper contact surfaces (10) are arranged to be in contact in coupled condition of the panels and preferably extend vertically at least partly; wherein the outside of the upward tongue (12) comprises a first locking element in the form of an outward bulge (18) and wherein the downward flank (16) is provided with a second locking element, in the form of a recess (19), wherein at least a part of the first and at least a part of second locking element are arranged to be in contact, in coupled condition of the panels and form a locking element surface (20).
28. Panel according to clause 26 or 27, wherein the outside of the outward bulge (18) comprises an upper portion (21) and an adjoining lower portion (22), wherein the lower portion comprises an inclined locking surface and the upper portion comprises a, preferably curved, guiding surface; wherein the recess (19) comprises an upper portion (23) and an adjoining lower portion (24), wherein the lower portion comprises an inclined locking surface; wherein the parts of the first and second locking element that are in contact, in coupled condition of the panels, are the inclined locking surfaces of the locking elements and/or wherein, in coupled condition of the panels, the upper portions of the first and second locking elements are spaced apart at least partially.
29. Panel according to one of the foregoing clauses, wherein the panel comprises a plurality of first edges and a plurality of second edges.
30. Panel according to one of the foregoing clauses, wherein the panel comprises at least one third edge and at least one opposite fourth edge, wherein said third edge comprises a third upper edge portion, wherein said fourth edge comprises a fourth upper edge portion;
a. at least one third coupling part arranged on said third edge, and at least one fourth coupling part arranged on said opposite fourth edge, wherein the third coupling part of said panel and the fourth coupling part of another panel are arranged to be coupled to provide a locking of two coupled panels, such that a least a part of the third upper edge portion faces, in particular co-acts or is configured to co-act with, at least a part of the fourth upper edge portion to form a top seam in between the panels;
b. wherein the third edge portion and/or the fourth edge portion is provided with at least one expandable material layer which comprises at least one material configured to expand or swell upon contact with moisture.
31. Panel according to one of the foregoing clauses, wherein the third coupling part and the fourth coupling part of another panel are arranged to be coupled by means of an angling down motion.
32. Panel according to one of the foregoing clauses, wherein the thickness of the expandable layer varies along its length, and preferably increases in a direction away from a, preferably vertical, part of the upper edge portion configured to co-act with the upper edge portion of an adjacent panel.
33. Covering, comprising multiple interconnected panels according to one of the foregoing clauses.
34. Method of manufacturing a panel according to one of clauses 1-32, comprising the steps of:
A) providing at least a first edge and an opposite second edge of a semi-finished panel with a first coupling part and a second coupling part respectively;
B) Applying at least one expandable material layer, comprising at least one material configured to expand or swell upon contact with moisture, onto at least a part of at least one upper edge portion of at least one profiled edge.
35. Method according to clause 34, wherein during step B) at least one expandable material layer is applied by means of spraying or printing, preferably digital printing.
36. Method according to clause 34 or 35, wherein during step B) at least one expandable material layer is applied by means of transfer printing.
37. Method according to clause 36, wherein during step B) a laminate of a decorative layer and at least one expandable layer is applied by means of transfer printing.
38. Method according to clause 36 or 37, wherein during step B) a transfer foil comprising at least one transferrable, expandable material layer is used, wherein the transfer foil is preferably removed after transfer of the at least one expandable material layer to the upper edge portion.
39. Transfer foil of the type which can be applied for covering at least a part of at least upper edge portion of a panel according to one of clauses 1-32, in particular by applying the method according to clause 38, wherein the transfer foil comprises at least one transferable, expandable material layer which comprises at least one material configured to expand or swell upon contact with moisture.

BRIEF DESCRIPTION OF THE DRAWINGS

The invention will be elucidated on the basis of non-limitative exemplary embodiments shown in the following figures, wherein.

DESCRIPTION OF THE INVENTION

Figure 1A:
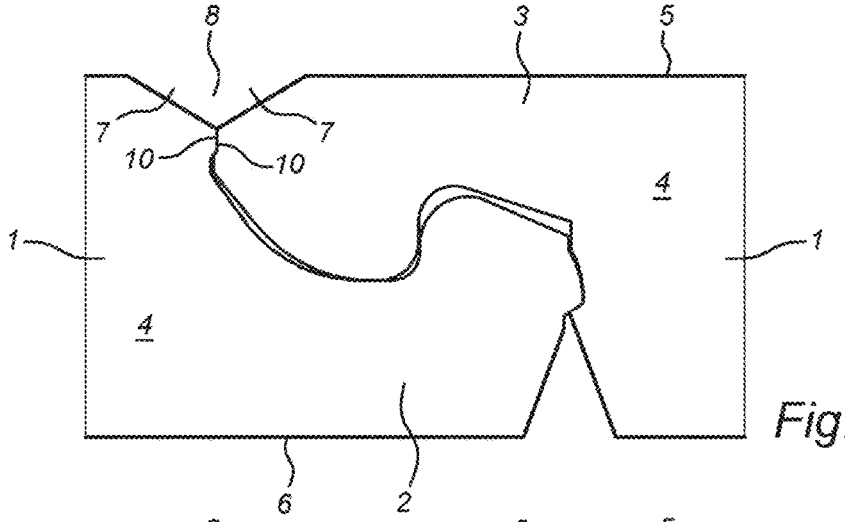
FIGS. 1*a*-1*c* show three schematic representations of two coupled panels, without material layers.
Figure 1B:
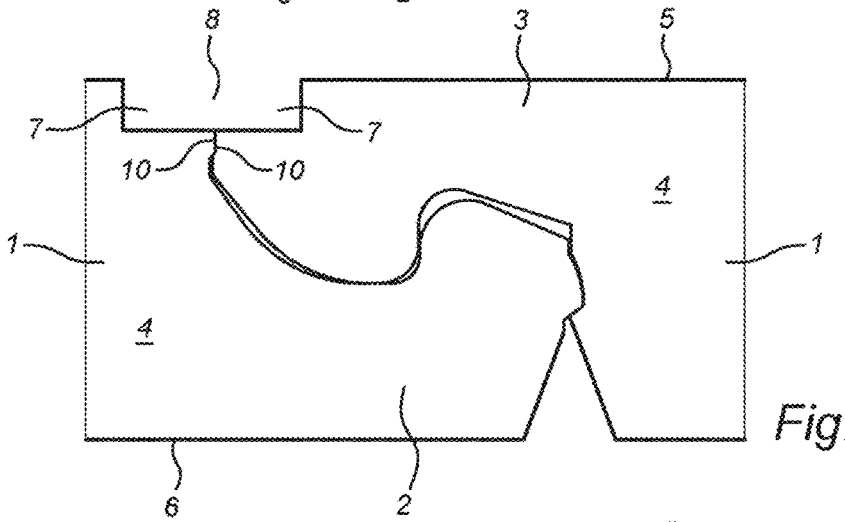
Figure 1C:
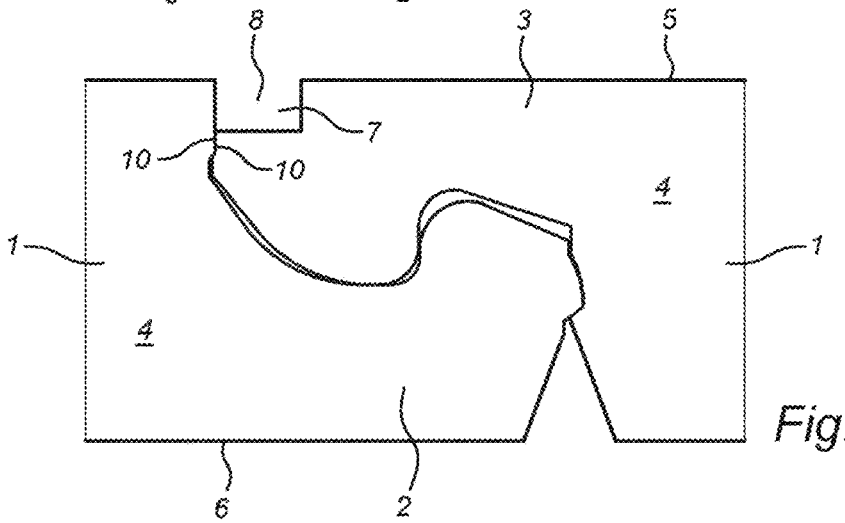

FIGS. 1*a*-1*c* schematically show two panels (1), each panel (1) comprising a first coupling part (2) and at least one second coupling part (3) arranged on opposite sides of the panel (1), wherein the first coupling part (2) of said panel and the second coupling part (3) of another panel (1) are arranged to be coupled to provide a locking of two coupled panels (1). Each panel (1) comprises a core (4) provided with an upper side (5) and a lower side (6), wherein at the upper side (5) of the core (4) a recessed portion (7) is provided, wherein in coupled condition the recessed portions (7) of two panels (1) form a recess (8), such as a grout or a bevel. Beneath the recess (8), the panels (1) are in contact at upper contact portions (10).

In FIG. 1*a*, the recess (8) is formed as a bevel, as the recessed portions (7) are both chamfered or angled portions. In FIG. 1*b*, the recess (8) is formed as a grout, as the recessed portions (7) are both square or rectangular in cross section, and together form a rectangular recess (8). In FIG. 1*c*, the right panel (1) is provided with a recessed portion (7) similar to the one shown in FIG. 1*b*, whereas the recessed portion (7) of the left panel coincides with the recess produced to form the first coupling part (2).

Figure 2A:
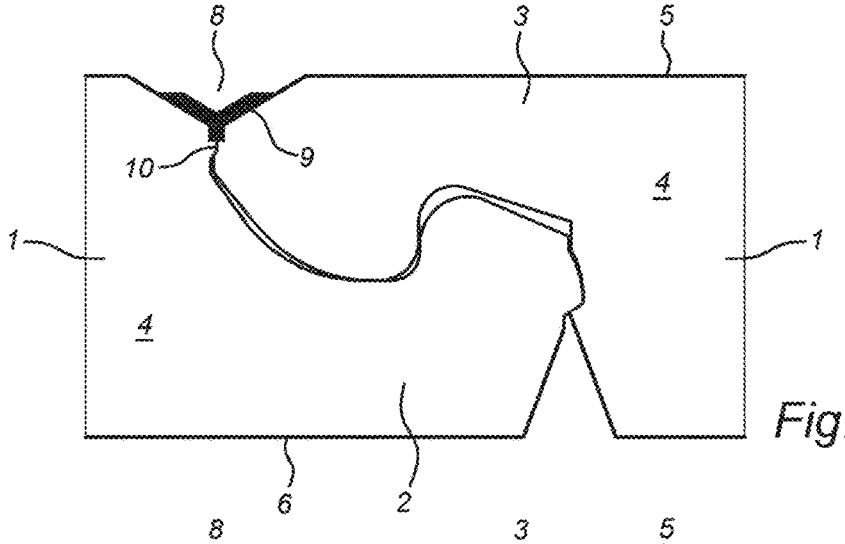
FIGS. 2*a*-2*f* show six schematic representation of two coupled panels with material layers according to the present invention.
Figure 2B:
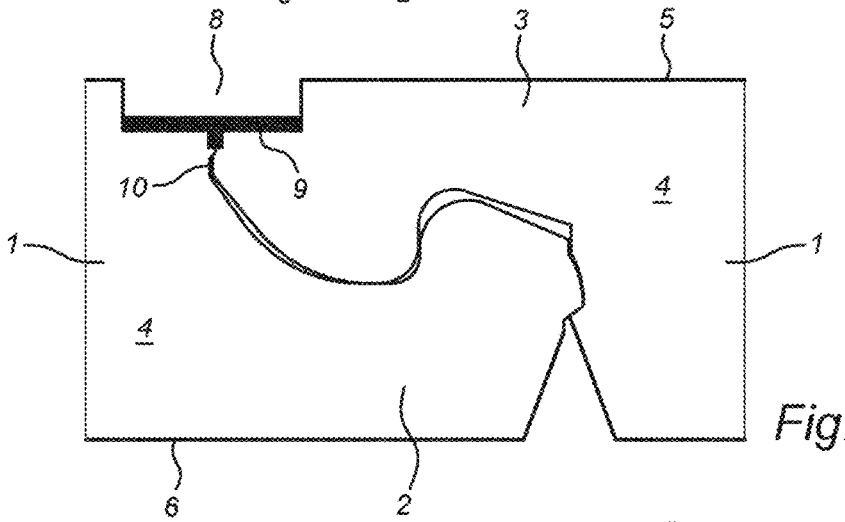
Figure 2C:
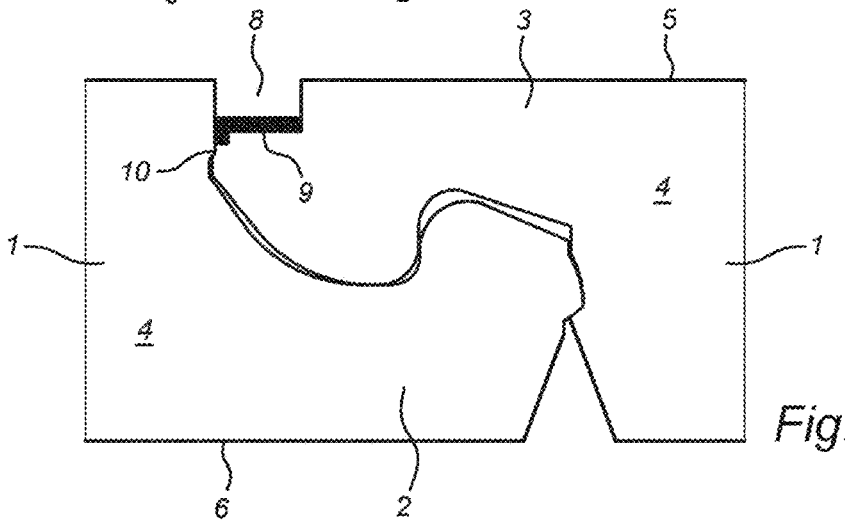
Figure 2D:
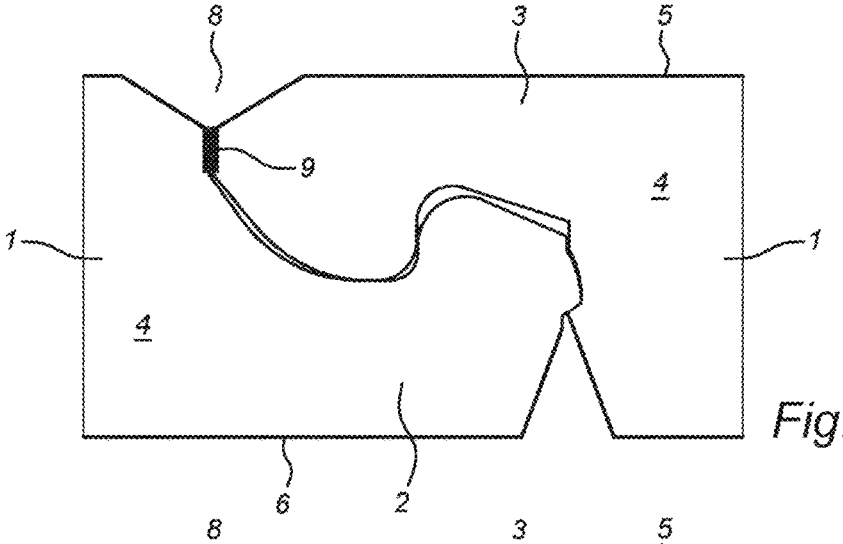
Figure 2E:
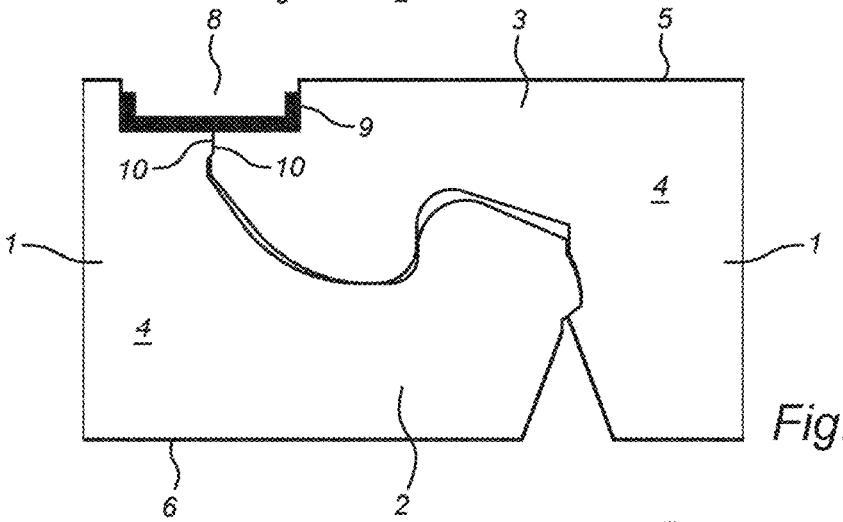
Figure 2F:
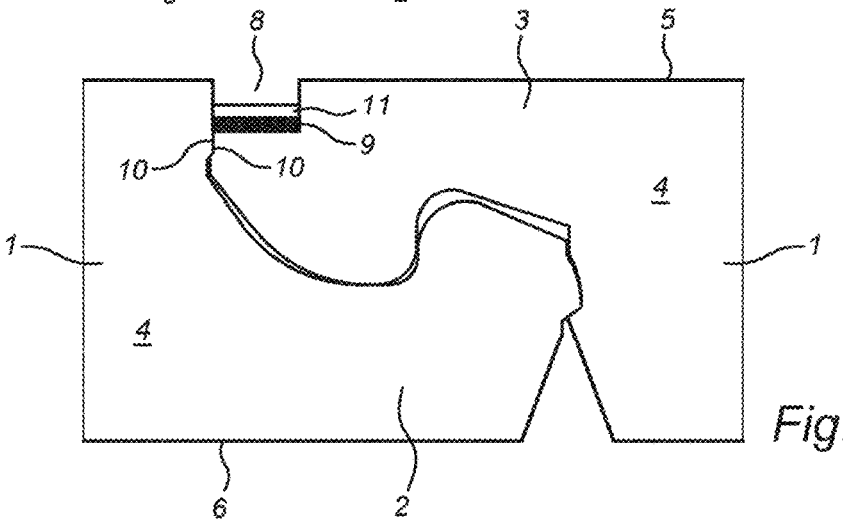

FIGS. 2*a*-2*f* show six schematic representation of two coupled panels with material layers (9). FIGS. 2*a* and 2*d* show panels like FIG. 1*a*, FIGS. 2*b* and 2*e* show panels like FIG. 1*b* and FIGS. 2*c* and 2*f* show panels like FIG. 1*c*, but these are interchangeable to some extent. Compared to the FIG. 1 embodiments, the coupled panels (1) are provided with a material layer (9).

In FIG. 2*a*, the material layer (9) is provided in a Y-shape, wherein a portion of the material layer (9) is provided on the chamfered or angled surfaces of the bevel, and another portion is provided between the upper contact surfaces (10) of the panels (1). It is imaginable that one of the portions is omitted, and that thus the material layer (9) is provided on the bevel only, or between the upper contact surfaces (10) only.

In FIG. 2*b*, the material layer (9) is provided in a T-shape, wherein a portion of the material layer (9) is provided on the bottom of the grout, and another portion is provided between the upper contact surfaces (10) of the panels (1). It is imaginable that one of the portions is omitted, and that thus the material layer (9) is provided on the grout only, or between the upper contact surfaces (10) only.

In FIG. 2*c*, the material layer (9) is provided with a portion of the material layer (9) on the bottom of the grout, and another portion is provided between the upper contact surfaces (10) of the panels (1). It is imaginable that one of the portions is omitted, and that thus the material layer (9) is provided on the grout only, or between the upper contact surfaces (10) only.

In FIG. 2*d*, the material layer (9) is provided between the upper contact surfaces (10) of the panels (1).

In FIG. 2*e*, the material layer (9) in a U-shape wherein a portion of the material layer (9) is provided on the bottom of the grout, and other portions are provided at the walls of the grout, from the bottom of the grout upward.

In FIG. 2*f*, the material layer (9) is provided at the bottom of the grout only. FIG. 2*f* also schematically shows the presence of a protective coating (11) on top of the material layer (9).

Figure 3A:
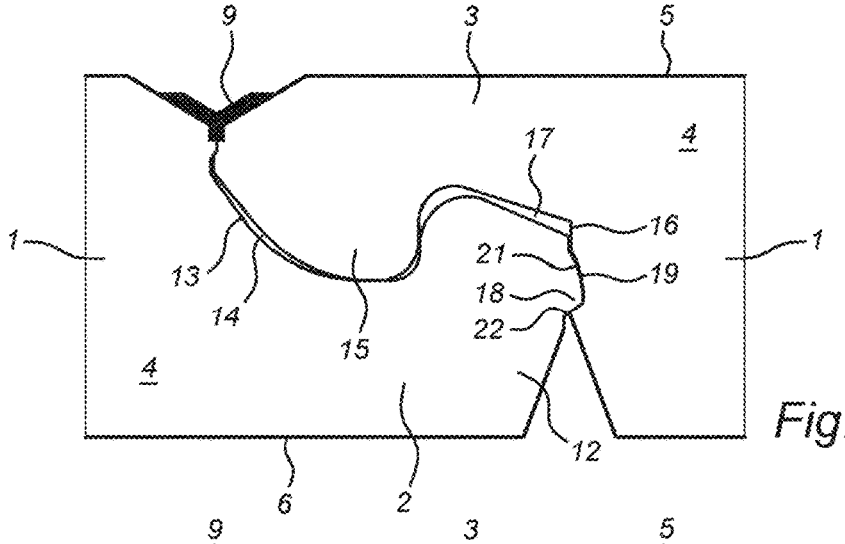
FIGS. 3*a*-3*c* schematically show various details of locking systems for panels according to the present invention.
Figure 3B:
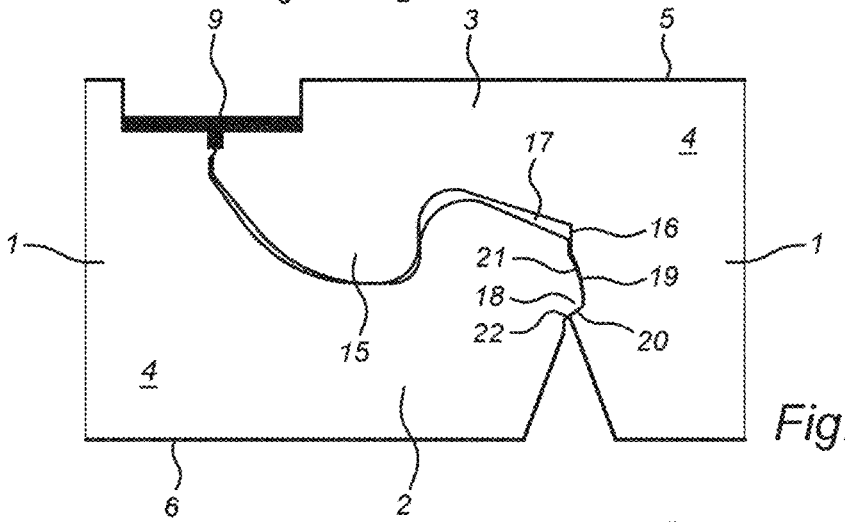
Figure 3C:
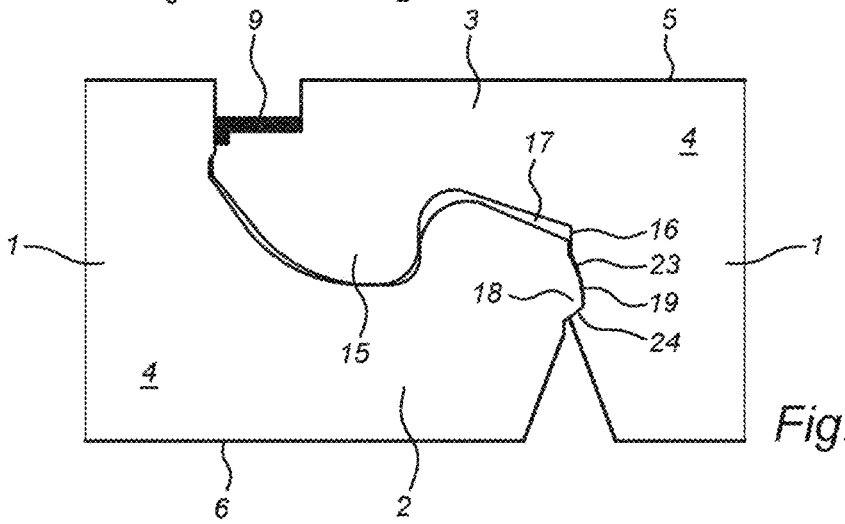

FIGS. 3*a*-3*c* schematically show a number of details for locking systems for panels according to the present invention. The figures show panels with first coupling part (2) and a second coupling part (3) arranged on opposite sides of the panel. wherein the first coupling part (2) comprises an upward tongue (12), an upward flank (13) lying at a distance from the upward tongue and an upward groove (14) formed in between the upward tongue (12) and the upward flank (13). The upward groove is adapted to receive at least a part of a downward tongue of a second coupling part of another panel, wherein the side of the upward tongue facing towards the upward flank is the inside of the upward tongue and the side of the upward tongue facing away from the upward flank is the outside of the upward tongue. The second coupling part (3) comprises a downward tongue (15*a* downward flank (16) lying at a distance from the downward tongue, and a downward groove (17) formed in between the downward tongue and the downward flank, wherein the downward groove is adapted to receive at least a part of an upward tongue of a first coupling part of another panel. The side of the downward tongue facing towards the downward flank is the inside of the downward tongue and the side of the downward tongue facing away from the downward flank is the outside of the downward tongue.

The outside of the downward tongue and the upward flank both comprise an upper contact surface (10) near or at or adjoining or towards a top or upper side of the panel, which upper contact surfaces (10) are arranged to be in contact in coupled condition of the panels and extend vertically. The outside of the upward tongue (12) comprises a first locking element in the form of an outward bulge (18) and the downward flank (16) is provided with a second locking element, in the form of a recess (19), wherein at least a part of the first and at least a part of second locking element are arranged to be in contact, in coupled condition of the panels and form a locking element surface (20).

The outside of the outward bulge (18) comprises an upper portion (21) and an adjoining lower portion (22), wherein the lower portion comprises an inclined locking surface and the upper portion comprises a curved guiding surface; wherein the recess (19) comprises an upper portion (23) and an adjoining lower portion (24), wherein the lower portion comprises an inclined locking surface; wherein the parts of the first and second locking element that are in contact, in coupled condition of the panels, are the inclined locking surfaces of the locking elements and/or wherein, in coupled condition of the panels, the upper portions of the first and second locking elements are spaced apart at least partially.

Figure 4:
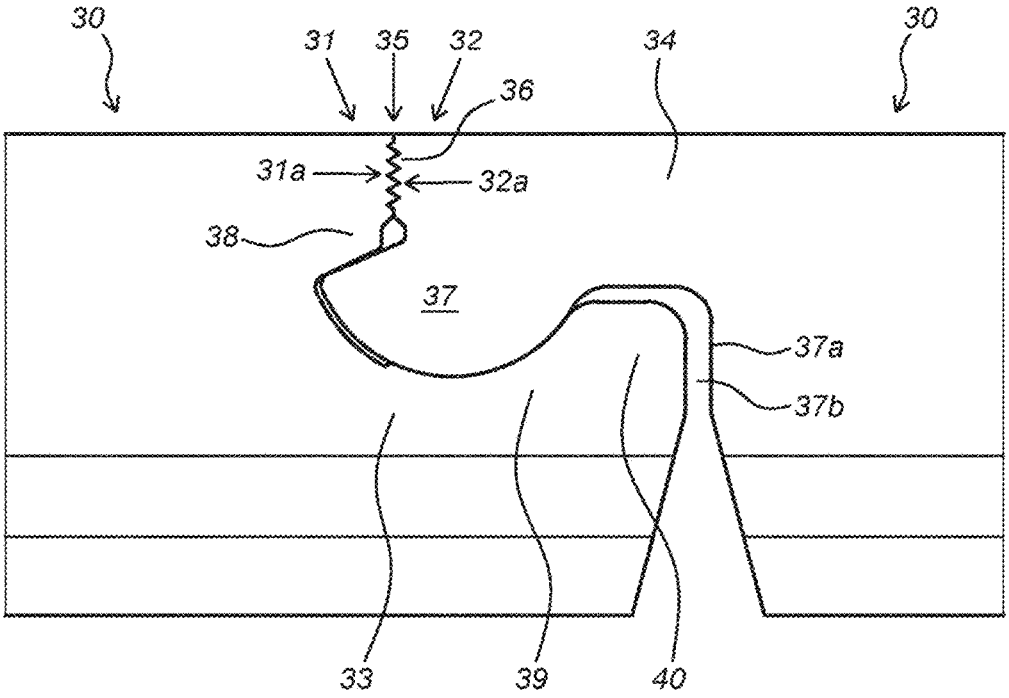
FIG. 4 schematically shows a cross section of two coupled panels according to the invention.

FIG. 4 shows a cross section of (a part of) two panels (30) according to the invention, in coupled condition. More in particular, this cross section shows a third edge (31) and a fourth edge (32) of the panel according to the invention. These edges (31, 32) may be combined with any of the first and second edges as shown in FIGS. 1*a*-3*c*. Alternatively, these edges (31, 32) may also be applied at remaining edges of the panel (30), wherein a panel (30) in this case would typically have two third edges and two fourth edges. The third edge (31) comprises a third upper edge portion (31*a*), wherein said fourth edge (32) comprises a fourth upper edge portion (32*a*). At least one third coupling part (33) arranged on said third edge (31), and at least one fourth coupling part (34) arranged on said opposite fourth edge (32), wherein the third coupling part (33) of the panel (30) and the fourth coupling part (34) of another panel (30) are arranged to be coupled to provide a locking of two coupled panels, such that a least a part of the third upper edge portion (31*a*) faces, in particular co-acts or is configured to co-act with, at least a part of the fourth upper edge portion (32*a*) to form a top seam (35) in between the panels; wherein the third upper edge portion (31*a*) and/or the fourth upper edge portion (32*a*) is provided with at least one expandable material layer (36) which comprises at least one material configured to expand or swell upon contact with moisture. The third coupling part (33) and the fourth coupling part (34) of another panel (30) are arranged to be coupled by means of an angling down motion, also referred to as turning or rotary movement. As shown in this figure, the third coupling part (30) comprises: a sideward tongue (37) extending in a direction substantially parallel to the upper side of the core, at least one second downward flank (37*a*) lying at a distance from the sideward tongue, and a second downward groove (37*b*) formed between the sideward tongue (37) and the second downward flank (37*a*), and wherein the fourth coupling part (34) comprises: a third groove configured for accommodating at least a part of the sideward tongue of the third coupling profile (33) of an adjacent panel (30), said third groove being defined by an upper lip (38) and a lower lip (39), wherein said lower lip (39) is provided with an upward locking element (40), wherein the third coupling part (33) and the fourth coupling part (34) are configured such that two of such panels (30) can be coupled to each other by means of a turning movement, wherein, as shown in FIG. 4, in the coupled condition at least a part of the sideward tongue (37) of a first panel (30) is inserted into the third groove of an adjacent, second panel, and wherein at least a part of the upward locking element (40) of said second panel is inserted into the second downward groove (37*b*) of said first panel (40). The panels (30) shown typically have a thickness situated in between and including 8 and 12 mm. A lower side of the upward sideward tongue (37) may comprise a flat portion, which is in particular advantageous in case thinner panels, typically having a thickness of 5 mm or less, are applied.

The above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re)combined in order to arrive at a specific application.

The verb "comprise" and conjugations thereof used in this patent publication are understood to mean not only "comprise", but are also understood to mean the phrases "contain", "substantially consist of", "formed by" and conjugations thereof.

What is claimed:

1. A panel comprising:

a. at least one first edge and at least one opposite second edge, wherein said first edge comprises a first upper edge portion, wherein said second edge comprises a second upper edge portion;

b. at least one first coupling part arranged on said first edge, and at least one second coupling part arranged on said opposite second edge, wherein the first coupling part of said panel and the second coupling part of another panel are arranged to be coupled to provide a locking of two coupled panels, such that at least a part of the first upper edge portion faces at least a part of the second upper edge portion to form a top seam in between the panels;

c. wherein at least one upper edge portion, chosen from the at least one first upper edge portion and the at least one second upper edge portion, is provided with a channel-shaped recessed portion extending along the length of said upper edge portion, wherein the recessed portion is configured to adjoin an upper edge portion of an adjacent panel, in coupled condition of two panels, d. wherein at least a part of said at least one upper edge portion, located directly below said channel-shaped recessed portion, is provided with at least one expandable material layer, the at least one expandable material layer comprising at least one material configured to expand or swell upon contact with moisture, wherein an exposed portion of said expandable material layer is in direct contact with an atmosphere surrounding the expandable material layer;

wherein the channel-shaped recess defines a bevel or grout line connecting an upper side of the panel and a side wall of the panel.

2. The panel according to claim 1, wherein the at least one expandable material layer is positioned such that during expanding or swelling of said expandable material layer upon contact with moisture, the top seam is tightened in a waterproof manner.

3. The panel according to claim 1, wherein the panel comprises a core, wherein the expandable material layer is affixed, either directly or indirectly, onto said core.

4. The panel according to claim 1, wherein, in coupled condition of two adjacent panels, the at least one expandable material layer provided at the at least one upper edge portion of a panel is at least partially covered by an opposing upper edge portion of an adjacent panel.

5. The panel according to claim 1, wherein, in coupled condition of two adjacent panels, the at least one expandable material layer provided at the at least one upper edge portion of a panel is at least partially left uncovered by an opposing upper edge portion of an adjacent panel.

6. The panel according to claim 1, wherein the thickness of the expandable layer increases in a direction away from a part of the upper edge portion configured to co-act with the upper edge portion of an adjacent panel.

7. The panel according to claim 1, wherein, the first one upper edge portion is provided with at least one first expandable material layer and wherein the second upper edge portion is provided with at least one second expandable material layer.

8. The panel according to claim 1, wherein the at least one upper edge portion is provided with a plurality of expandable material layers, wherein each expandable material layer comprises at least one material configured to expand or swell upon contact with moisture.

9. The panel according to claim 1, wherein each upper edge portion is provided with at least one expandable material layers, wherein, in coupled condition of adjacent panels, the expandable material layers of opposing upper edge portions are configured to co-act with each other.

10. The panel according to claim 1, wherein the at least one expandable material layer is formed by a material strip.

11. The panel according to claim 1, wherein the at least one expandable material layer follows the shape of a curved and/or angled portion of a coupling part.

12. The panel according to claim 1, wherein the thickness of at least one expandable material layer decreases in a direction away from an outer end of the panel edge.

13. The panel according to claim 1, wherein the thickness of the expandable material layer is between 10 and 1000 micron.

14. The panel according to claim 1, wherein the at least one expandable material layer provided is partially covered by at least one protective layer.

15. The panel according to claim 1, wherein at least a part of each upper edge portion, located below said channel-shaped recessed portion, is configured to act as contact surface, wherein the upper contact surfaces are arranged to be in contact in coupled condition of the panels.

16. The panel according to claim 15, wherein the contact surfaces extend vertically at least partly.

17. The panel according to claim 1, wherein the expandable material is at least partially enclosed by a core of the panel and a decorative layer of the panel.

18. The panel according to claim 1, wherein the material layer comprises at least one hydrogel-forming water-swellable polymer.

19. The panel according to claim 1, wherein the expandable material layer, in swollen or expanded state, forms a water-impermeable barrier, a waterproof barrier and/or a water-resistant barrier.

20. The panel according to claim 1, wherein the first coupling part and the second coupling part of another panel are arranged to be coupled by means of a downward motion; wherein the first coupling part comprises an upward tongue, at least one upward flank lying at a distance from the upward tongue and an upward groove formed in between the upward tongue and the upward flank, wherein the upward groove is adapted to receive at least a part of a downward tongue of a second coupling part of another panel, wherein the side of the upward tongue facing towards the upward flank is the inside of the upward tongue and the side of the upward tongue facing away from the upward flank is the outside of the upward tongue; wherein the second coupling part comprises a downward tongue, at least one downward flank lying at a distance from the downward tongue, and a downward groove formed in between the downward tongue and the downward flank, wherein the downward groove is adapted to receive at least a part of an upward tongue of a first coupling part of another panel, wherein the side of the downward tongue facing towards the downward flank is the inside of the downward tongue and the side of the downward tongue facing away from the downward flank is the outside of the downward tongue.

21. The panel according to claim 1, wherein the panel comprises at least one third edge and at least one opposite fourth edge, wherein said third edge comprises a third upper edge portion, wherein said fourth edge comprises a fourth upper edge portion;

a. at least one third coupling part arranged on said third edge, and at least one fourth coupling part arranged on said opposite fourth edge, wherein the third coupling part of said panel and the fourth coupling part of another panel are arranged to be coupled to provide a locking of two coupled panels, such that at least a part of the third upper edge portion faces at least a part of the fourth upper edge portion to form a top seam in between the panels;

b. wherein the third edge portion and/or the fourth edge portion is provided with at least one expandable material layer which comprises at least one material configured to expand or swell upon contact with moisture.

22. The panel according to claim 1, wherein the panel comprises a layered structure, comprising a core layer and at least one decorative top section, directly or indirectly affixed to said core layer, wherein the top section defines a top surface of the panel, and wherein the top section comprises at least one decorative layer affixed, either directly or indirectly, to an upper surface of the core layer.

* * * * *